US005575629A

United States Patent [19]

Olson et al.

[11] Patent Number: 5,575,629

[45] Date of Patent: Nov. 19, 1996

[54] VAPOR CONTROL SYSTEM

[75] Inventors: Scott M. Olson, Grand Rapids; David O. Roe, Wyoming; Gregory P. Wood, Kentwood, all of Mich.

[73] Assignee: Delaware Capital Formation, Inc., Wilmington, Del.

[21] Appl. No.: 236,205

[22] Filed: May 2, 1994

[51] Int. Cl.[6] ..... F04B 17/00

[52] U.S. Cl. ..... 417/405; 141/59

[58] Field of Search ..... 417/405, 406, 417/407; 222/72, 367, 368; 141/95, 46, 52, 45, 44

[56] References Cited

U.S. PATENT DOCUMENTS

| | | | |
|---|---|---|---|
| 2,291,856 | 8/1942 | Willson . | |
| 2,671,462 | 3/1954 | Grier | 417/406 |
| 3,016,928 | 1/1962 | Brandt . | |
| 3,178,102 | 4/1965 | Grisbrook | 417/406 |
| 3,181,729 | 5/1965 | Milonas et al. . | |
| 3,198,126 | 8/1965 | Minich . | |
| 3,291,384 | 12/1966 | Garland . | |
| 3,748,068 | 7/1973 | Keller . | |
| 3,850,208 | 11/1974 | Hamilton . | |
| 4,068,687 | 1/1978 | Long | 141/59 |
| 4,295,802 | 10/1981 | Peschke . | |
| 4,687,033 | 8/1987 | Furrow et al. . | |
| 4,799,940 | 1/1989 | Millikan . | |
| 5,038,838 | 8/1991 | Bergamini et al. . | |
| 5,150,742 | 9/1992 | Motohashi et al. | 141/59 |
| 5,199,471 | 4/1993 | Hartman et al. . | |
| 5,213,142 | 5/1993 | Koch et al. . | |
| 5,234,036 | 8/1993 | Butkovich et al. . | |
| 5,297,594 | 3/1994 | Rabinovich | 141/59 |
| 5,341,855 | 8/1994 | Rabinovich | 141/46 |
| 5,392,824 | 2/1995 | Rabinovich | 141/44 |
| 5,394,909 | 3/1995 | Mitchell et al. | 141/59 |

FOREIGN PATENT DOCUMENTS

| | | | |
|---|---|---|---|
| 798867 | 8/1973 | Belgium . | |
| 0022103 | 1/1981 | European Pat. Off. . | |
| 1628275 | 8/1970 | Germany . | |
| 2905044 | 8/1979 | Germany | 141/59 |

*Primary Examiner*—Timothy S. Thorpe
*Attorney, Agent, or Firm*—Flynn, Thiel, Boutell & Tanis, P.C.

[57] ABSTRACT

A motor/pump unit for pumping vapor in response to a flow of liquid, and particularly useful in systems for dispensing fuel to a vehicle wherein vapor given off by the fuel is to be returned from the filling port of the vehicle back to the fuel dispensing apparatus to avoid atmospheric contamination. One inventive embodiment, with available conventional fuel dispenser pressure and flow rate, allows abnormally small motor and pump chambers and motor/pump rotor assembly size and abnormally high rotor assembly rotation rate and abnormally quick rotor assembly acceleration to operating speed with sufficient vapor pumping capability. The resulting abnormally small motor/pump enables same to be easily adapted to a variety of existing dispensing pump and hose configurations. Under another embodiment, structure is provided for maximizing fuel flow rate and minimizing pressure drop across the motor/pump unit while providing adequate vapor pumping rate. Under another embodiment, structure is manually adjustable for varying the vapor pumping capacity of the motor/pump, for example to accommodate seasonal changes in fuel composition.

31 Claims, 11 Drawing Sheets

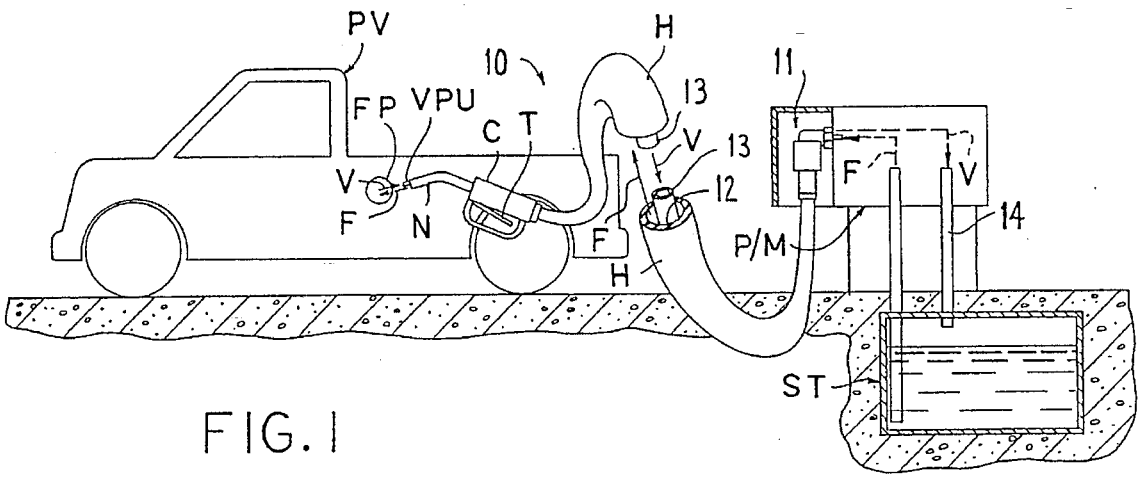
FIG. 1
FIG. 2
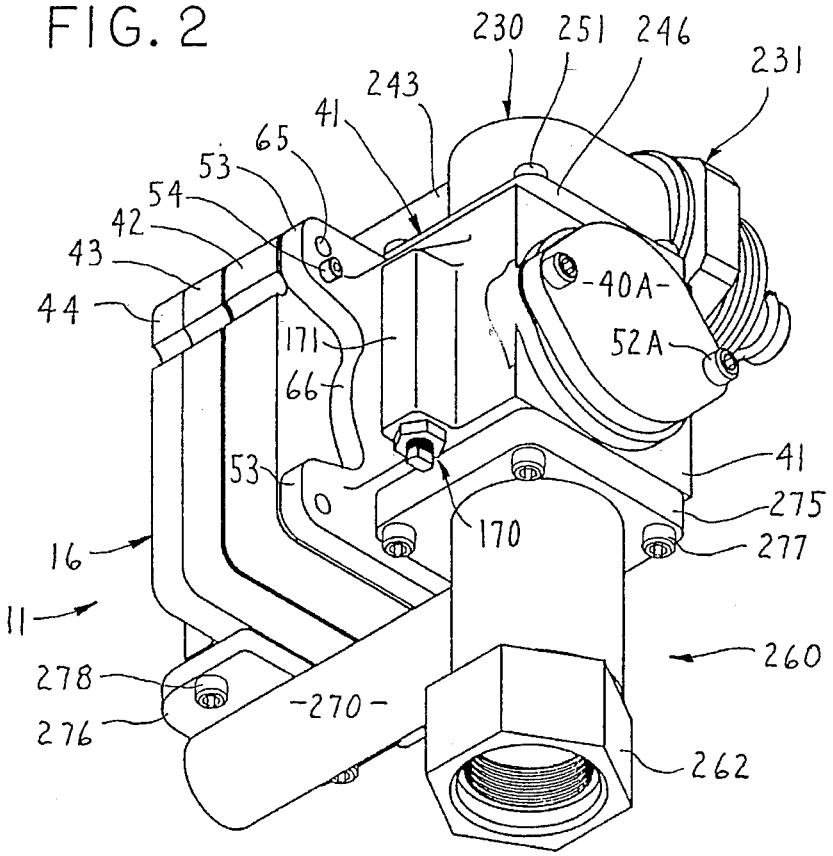

P/M
F
ST
V
V
F

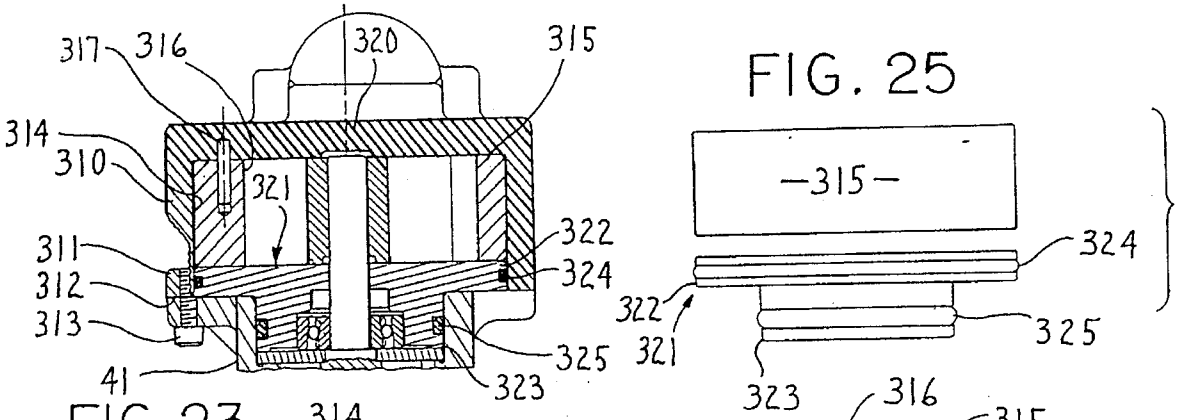
FIG. 23
FIG. 25
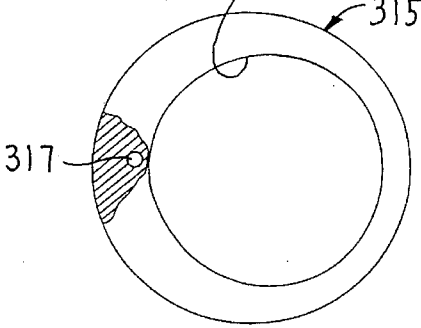
FIG. 26
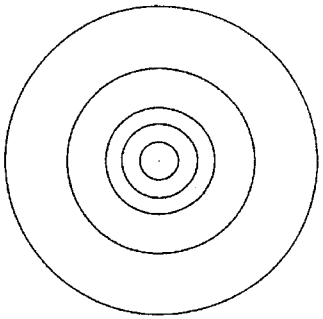
FIG. 27
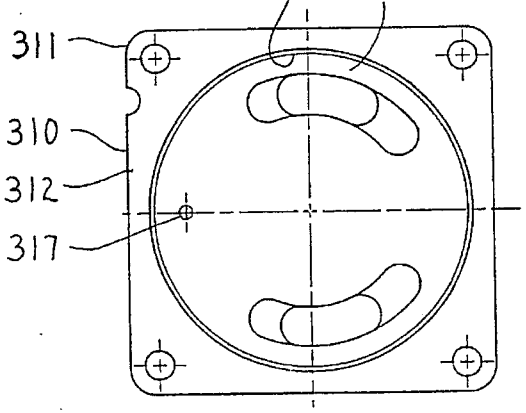
FIG. 24

VAPOR CONTROL SYSTEM

FIELD OF THE INVENTION

This invention relates to a vapor control system and more particularly to a combined motor-pump apparatus adapted to be driven by a liquid such as gasoline for pumping of a vapor such as gasoline vapor.

BACKGROUND OF THE INVENTION

U.S. Pat. No. 4,295,802, owned by the Assignee of the present invention, discloses a vapor control system suitable for dispensing of a volatile hydrocarbon fuel, such as gasoline, into fuel tanks of motor vehicles (for example automotive vehicles, aircraft, boats, and the like). There has been a need for capturing and handling the vapor escaping from the filler spout of the motor vehicle fuel tank during the dispensing operation. Such U.S. Pat. No. 4,295,802 discloses a successful pump for capturing the vapor from the filler spout of the vehicle during fueling, which vapor pump is driven by a fluid motor which is responsive to the filling flow of fuel therethrough toward the filler spout of the motor vehicle.

While the device disclosed in aforementioned U.S. Pat. No. 4,295,802 has proved satisfactory in use, a continuing effort to improve apparatus of this kind has resulted in the present invention.

Accordingly, the objects and purposes of the present invention include providing an improved motor-pump apparatus, particularly one of the general type set forth in the above-mentioned U.S. Pat. No. 4,295,802.

Other objects and purposes of the invention will be apparent to persons familiar with apparatus of this general type upon reading the following specification and inspecting the accompanying drawings.

SUMMARY OF THE INVENTION

A motor/pump unit for pumping vapor in response to a flow of liquid, and particularly useful in systems for dispensing fuel to a vehicle wherein vapor given off by the fuel is to be returned from the filling port of the vehicle back to the fuel dispensing apparatus to avoid atmospheric contamination. One inventive embodiment, with available conventional fuel dispenser pressure and flow rate, allows abnormally small motor and pump chambers and motor/pump rotor assembly size and abnormally high rotor assembly rotation rate and abnormally quick rotor assembly acceleration to operating speed with sufficient vapor pumping capability. The resulting abnormally small motor/pump enables same to be easily adapted to a variety of existing dispensing pump and hose configurations. Under another embodiment, structure is provided for maximizing fuel flow rate and minimizing pressure drop across the motor/pump unit while providing adequate vapor pumping rate. Under another embodiment, structure is manually adjustable for varying the vapor pumping capacity of the motor/pump, for example to accommodate seasonal changes in fuel composition.

BRIEF DESCRIPTION OF THE DRAWINGS

FIG. 1 schematically shows a volatile fuel dispensing apparatus which embodies the present invention.

FIG. 2 is a pictorial view of the motor/pump unit of FIG. 1.

FIG. 23 corresponds generally to FIG. 4 but shows a vapor pump cup substituted for the inboard head, pump cylinder and outboard pump head of FIG. 4.

FIG. 24 shows the open end of the vapor pump cup alone and looking upward in FIG. 23.

FIG. 25 is an exploded elevational view of the pump chamber liner and inboard bulkhead of FIG. 23.

FIG. 26 is a partially broken end view of the liner of FIGS. 23 and 25.

FIG. 27 is an end view of the inboard bulkhead of FIGS. 23 and 25.

DETAILED DESCRIPTION

Figures 3, 4, 5, 6:
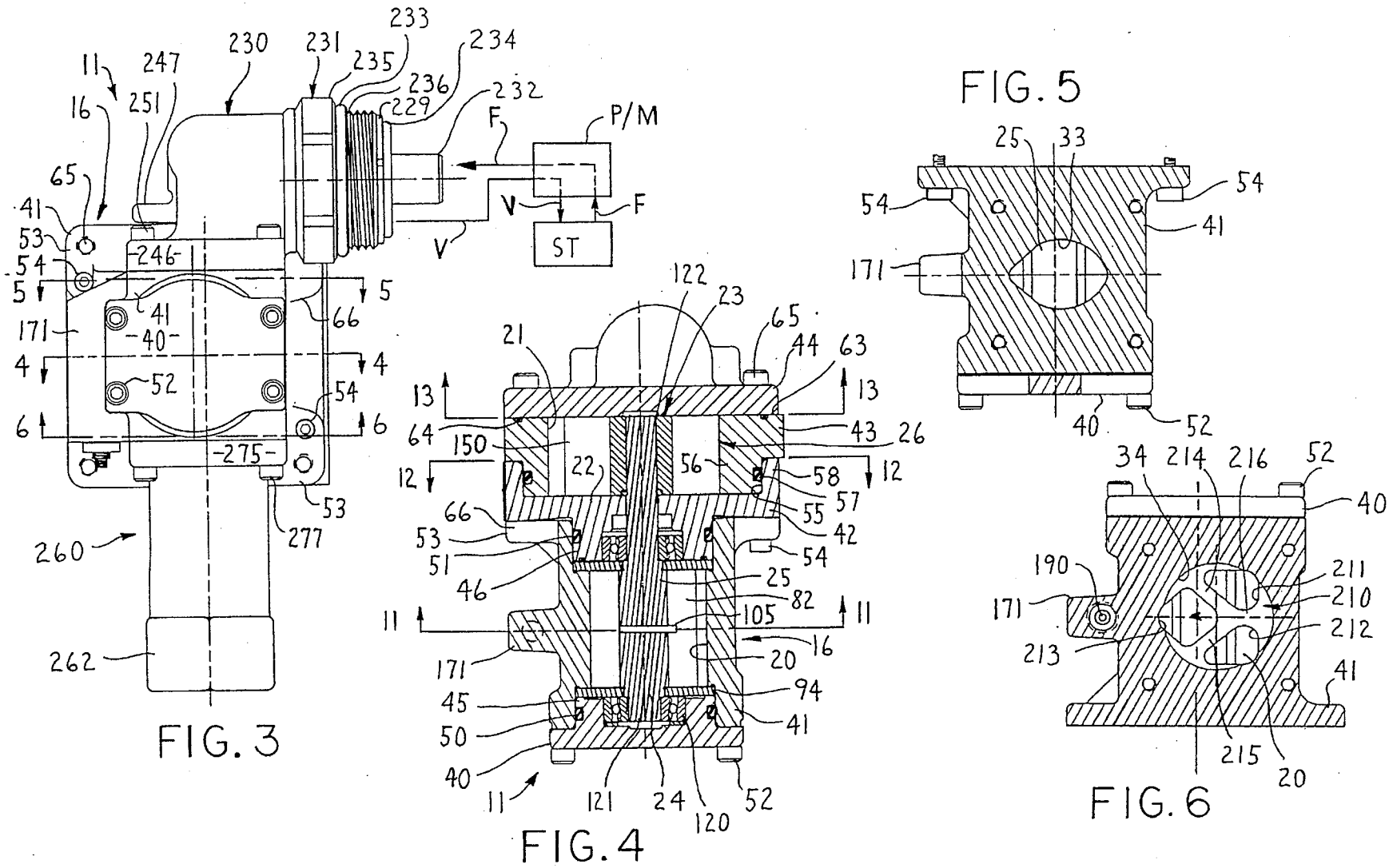
FIG. 3 is an enlarged front view of the motor/pump unit of FIG. 1.
FIG. 4 is a sectional view substantially taken on the line 4—4 of FIG. 3.
FIG. 5 is a sectional view of the front part of the FIG. 3 motor/pump unit taken substantially on the line 5—5 of FIG. 3.
FIG. 6 is a sectional view similar to FIG. 5 but taken on the line 6—6 of FIG. 3.

FIG. 1 schematically shows a system 10 for preventing loss to the air of volatile vapor V while feeding a volatile fuel (e.g. gasoline, diesel fuel, kerosene, alcohol, or other volatile fuel) F to the fill port FP of a powered vehicle PV (such as a car, truck, aircraft, boat, or other vehicle). The system 10 comprises a typical environment for use of the present invention. In the embodiment shown in FIG. 1, the system 10 comprises a pumping and metering unit P/M for pumping fuel from a storage tank ST (typically an underground storage tank) through the motor chamber (not shown in FIG. 1) of a vapor recovery motor/pump unit 11, the fuel passage 12 of a two passage fuel/vapor hose H, a hand held fuel flow controller C having a manually actuable fuel flow rate trigger T and a fuel outlet nozzle N insertable in the fuel port FP of the vehicle PV for filling its fuel tank (not shown). Associated with the nozzle N and insertable therewith into the fuel port FP is a vapor pickup, schematically indicated at VPU. The vapor pick up VPU connects through a vapor return passage 13 extending through the controller C and hose H, thence through a vapor pumping chamber (not shown) of the vapor recovery motor/pump 11 and a vapor return conduit schematically indicated at 14 extending through the fuel pumping and metering unit P/M back to the storage tank ST. The system 10 is thus used to feed fuel from the storage tank ST to the filler port FP of the powered vehicle PV, while recovering volatile vapors V and returning same to the storage tank ST, or other place of safety, and thereby preventing escape of such volatile vapors to the atmosphere, and so reducing hydrocarbon pollution of the environment.

To the extent above-described, the system 10 is conventional and may be of the general type disclosed in connection with FIG. 1 of aforementioned prior U.S. Pat. No. 4,295,802.

Figure 8:
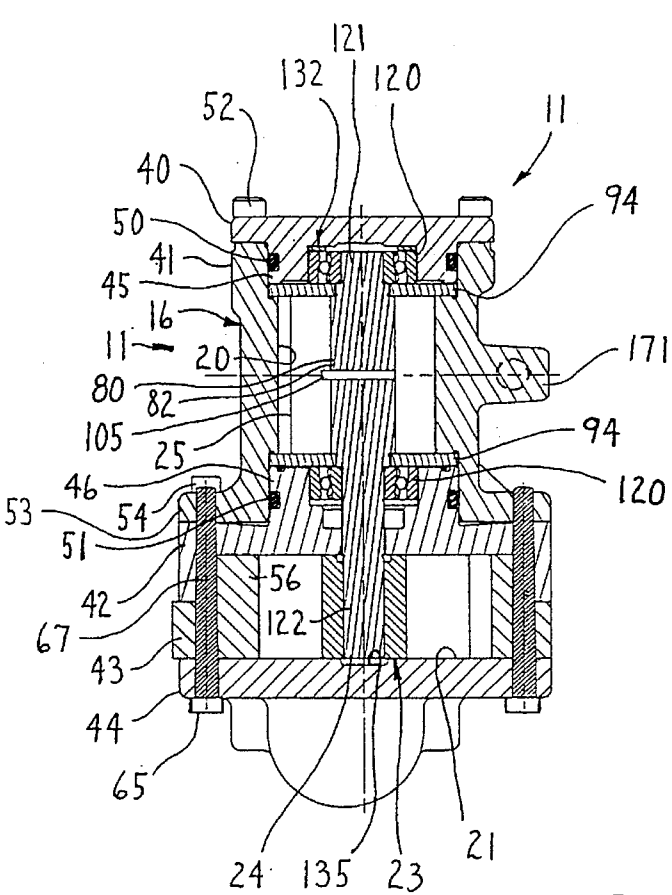
FIG. 8 is a sectional view taken substantially on the line 8—8 of FIG. 7.
Figure 7:
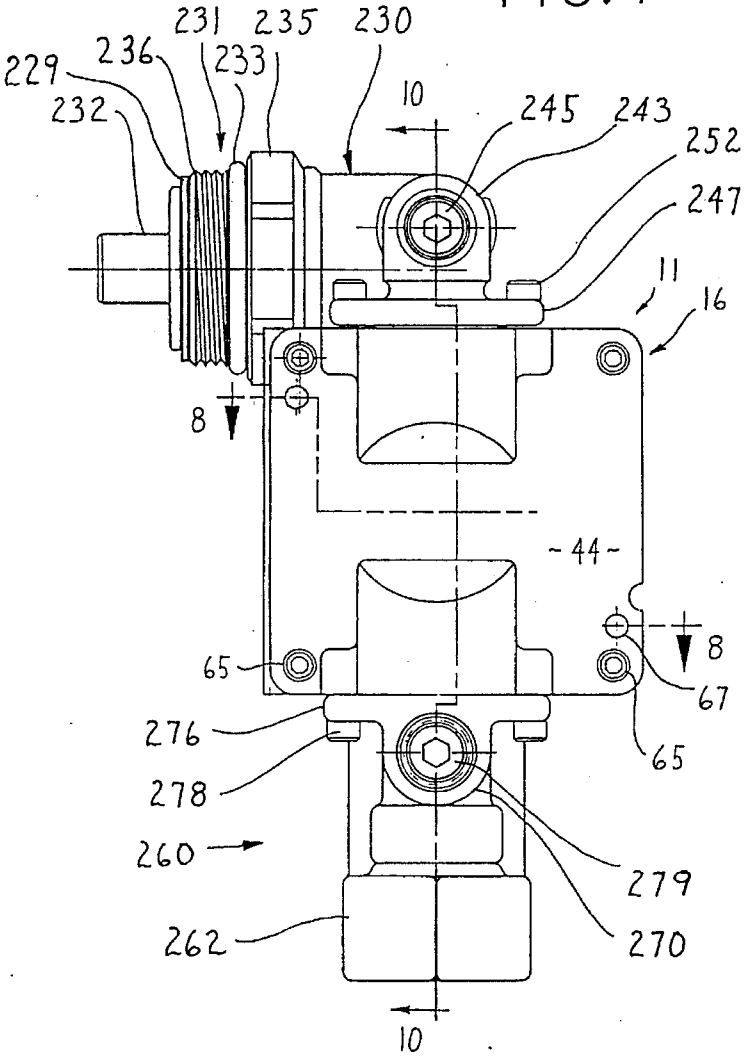
FIG. 7 is a rear elevational view of the motor/pump unit of FIG. 3.
Figure 12:
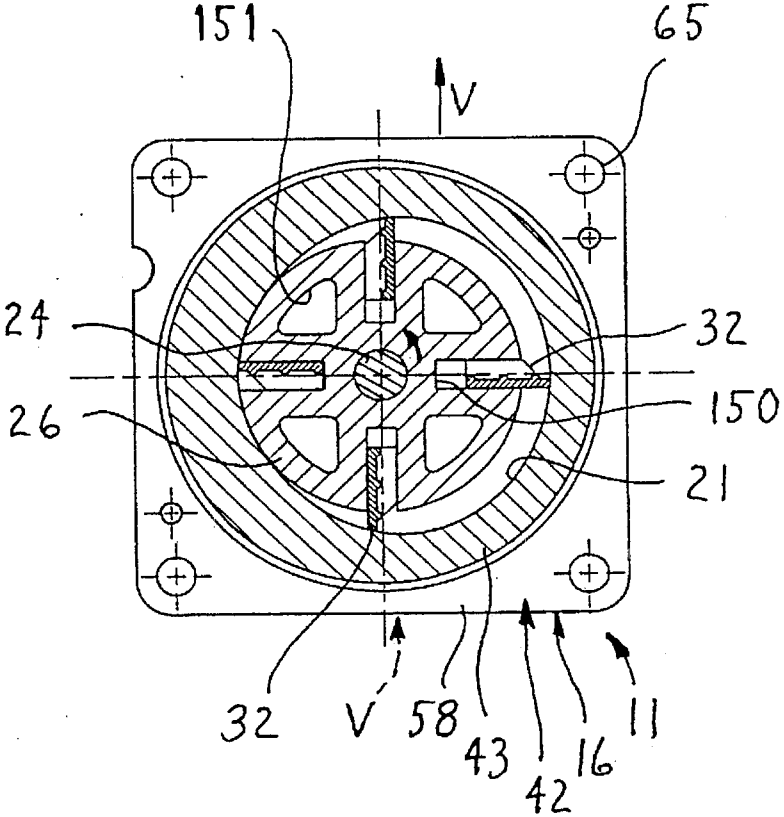
FIG. 12 is a sectional view taken substantially on line 12—12 of FIG. 4.

The vapor recovery motor/pump unit 11 comprises a housing 16 (FIGS. 2, 4 and 8). The housing 16 contains a motor chamber 20 and a pump chamber 21, which are arranged side by side on opposite sides of a separating wall 22. A rotor assembly 23 comprises a shaft 24 which is rotatable with respect to the housing 16 and extends longitudinally through the chambers 20 and 21 and the separating wall 22 therebetween. The rotor assembly further includes a motor impeller 25 and pump impeller 26 (FIGS. 4, 11 and 12) coaxially fixed with respect to and thus rotatable with the shaft 24. The impellers 25 and 26 carry circumferentially spaced, radially slidable vanes 31 and 32 respectively (FIGS. 11 and 12). For convenience in illustration, the vanes 31 and 32 are not shown in the FIG. 4, 8 and 10 cross-sectional views. In conventional vane pump and motor fashion, the chambers 20 and 21 are of generally circular cross-section, and are located somewhat eccentrically of the corresponding impellers 25 and 26, as seen for example in FIGS. 4, 11 and 12.

A fuel inlet port 33 and outlet port 34 (FIG. 10) open into the motor chamber 20 in communication with opposite sides of the motor impeller 25. A vapor inlet port 35 and vapor outlet port 36 open to the pump chamber 21 generally on opposite sides of the pump impeller 26.

To the extent above described, the fueling system 10 is similar to that above disclosed in aforementioned U.S. Pat. 4,295,802, owned by the Assignee of the present invention and upon which the present invention is intended to be an improvement.

Turning now to details more specifically directed to the present invention, the housing 16 (FIG. 10) comprises a series of side by side housing elements 40–44 stacked along the axis of the shaft 24. Such housing elements here comprise, in sequence, an outboard motor head 40, a motor cylinder 41, an inboard head 42, a pump cylinder 43 and an outboard pump head 44.

In FIG. 2, the outboard motor head is modified in profile and is indicated at 40A. The modified outboard motor head 40A has a generally rounded profile and a two screw fixation system, as compared to the outboard motor head 40 of FIGS. 3–10, which, as seen in FIG. 3, has a more rectangular profile and a four screw fixation.

Elements 40, 41 and 42 bound the motor chamber 20 and elements 42, 43 and 44 bound the pump chamber 21. The element 42 defines the aforementioned separating wall 22. The outboard motor head 40 and inboard head 42 (FIG. 8) have coaxial annular bosses 45 and 46, respectively, which extend coaxially toward each other on opposite sides of the motor chamber 20. Circular recesses in axial end portions of the motor cylinder 41 snugly telescopingly receive the bosses 45 and 46. Annular seals 50 and 51 in annular grooves in the bosses 45 and 46 respectively seal against the interior face of the axial overlapping end portions of the motor cylinder 41. Such prevents fuel leakage out of the motor chamber 20.

Screws 52 extend through peripheral portions of the outboard motor head 40 into the opposed end of the motor cylinder 41 to fix the outboard motor head 40 to the adjacent end of the motor cylinder 41. Four such screws 52 are employed in the embodiment of FIGS. 3 through 12, whereas only two cylinder screws 52A are used with the modified outboard motor head 40A of FIG. 2. A radially outwardly extending flange 53 on the inboard end of the motor cylinder 41 abuts axially against the outer peripheral portion of the inboard head 42 and affixed thereto by axially extending screws 54 (FIG. 4).

A circular cylindrical recess 55 (FIG. 4) in the inboard head 42 faces axially into the pump chamber 21 and at its outer periphery axially telescopingly receives snugly therein an inner end portion 56, of reduced outside diameter, of the pump cylinder 43. An annular seal 57 surrounding the reduced diameter inner end portion 56 of the pump cylinder 43 seals against the radially surrounding portion 58 of the inboard head 42.

The outboard pump head 44 (FIG. 4) has a substantially flat face which abuts the outboard end 63 of the pump cylinder 43. A seal ring 64 is recessed in the outboard end 63 of the pump cylinder 43 and seals against the outboard pump head 44. Screws 65 (FIGS. 3, 4, 7 and 8) extend axially through the outboard pump head 44, pump cylinder 43, and inboard head 42 and thread into the flanges 53 of the motor cylinder 41 to axially clamp those members fixedly together. Such housing elements 44, 43, 42 and 53 have substantially square external profiles (except for indents 66 in opposed side edges of the flange 53), as seen for example in FIG. 2, and the screws 65 are located at the four corners of such square profile, radially well outward from the pump chamber 21. A pair of alignment pins 67 (FIGS. 7 and 8) extend axially through the same housing elements 44, 43, 42 and 53 to maintain same properly axially aligned as discussed below. The alignment pins 67 are here generally diametrally spaced from each other on opposite sides of the pump chamber 21, are spaced radially outward from the pump chamber 21 and are located near (but not at) two diagonally opposed corners of the generally square profile of the outboard pump head 44. The aforementioned screws 54 are also diametrally opposed across the pump chamber 21, but are located near (though not at) the other two diagonal corners of the substantially square external profile of the axially stacked members 44, 43, 42 and 53.

The screws 54 through the flanges 53 allow preassembly of the shaft 24 in the motor chamber 20 (bounded by the housing 40, 41 and 42), prior to addition of the pump cylinder 43 and outboard pump head 44 to the housing 16.

The alignment pins 67 are slightly tapered and are axially forced snugly into correspondingly tapered holes bored in the members 44, 43, 42 and 53, after the screws 65 are tightened to clamp same together. The pins 67 are a tight wedge fit with respect to the members 44, 43, 42 and 53 and positively prevent any rotation, even slight, of the members 44, 43, 42 and 41 with respect to each other, after assembly, for example if the pump is dropped on the floor or otherwise maltreated. It is particularly important to maintain precise coaxial and circumferential alignment of the housing elements 44, 43, 42, 41 and 40, to avoid any slight impediment to the rotational freedom of the shaft 24, and the motor and pump impellers 25 and 26 fixed on the shaft, so as not to degrade the ability of the inventive motor/pump 11 to pump vapor at a sufficient rate with minimal reduction in fuel delivery rate.

Figure 13:
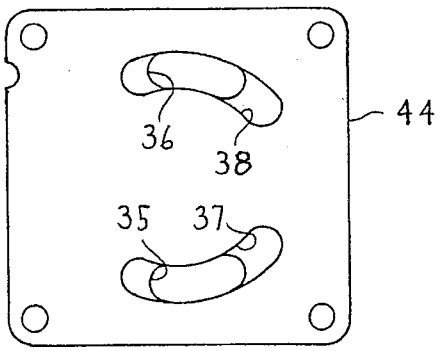
FIG. 13 is a sectional view substantially taken on the line 13—13 of FIG. 4.

Whereas the fuel inlet port 33 and outlet port 34 extend radially out of the motor chamber 20, for minimum restriction of fuel flow rate, the easier flowability of vapor permits the vapor inlet port 35 and outlet port 36 (FIG. 10) to extend axially from the pump chamber 21 into the outboard pump head 44. In the embodiment shown, the vapor inlet port 35 and outlet port 36 each have a circumferentially extending inlet groove, of relatively short (for example about 20° circumferential) extent opening to pump chamber 21, as indicated at 37 and 38 respectively in FIGS. 10 and 13 and serving as the point of communication between the vapor pump chamber 21 and the corresponding vapor inlet port 35 and outlet port 36 respectively.

Figure 10:
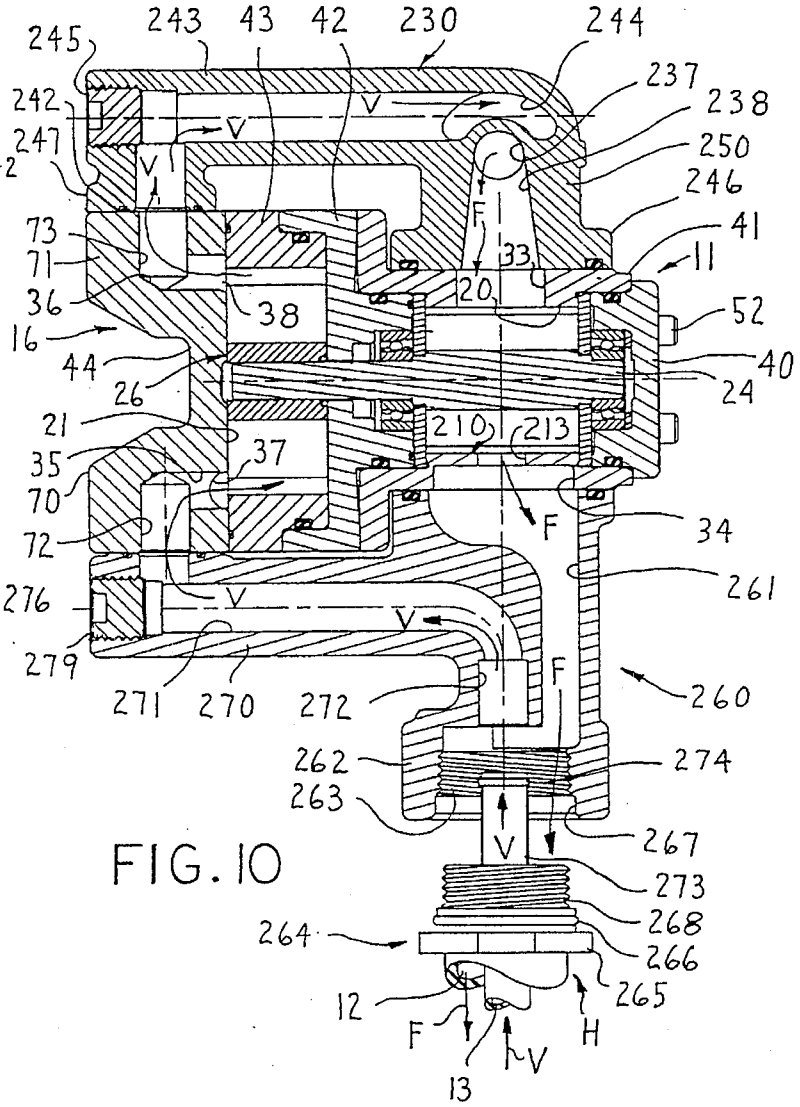
FIG. 10 is a sectional view taken substantially on line 10—10 of FIG. 7, and hence with the left part of the pump housing removed.
Figure 9:
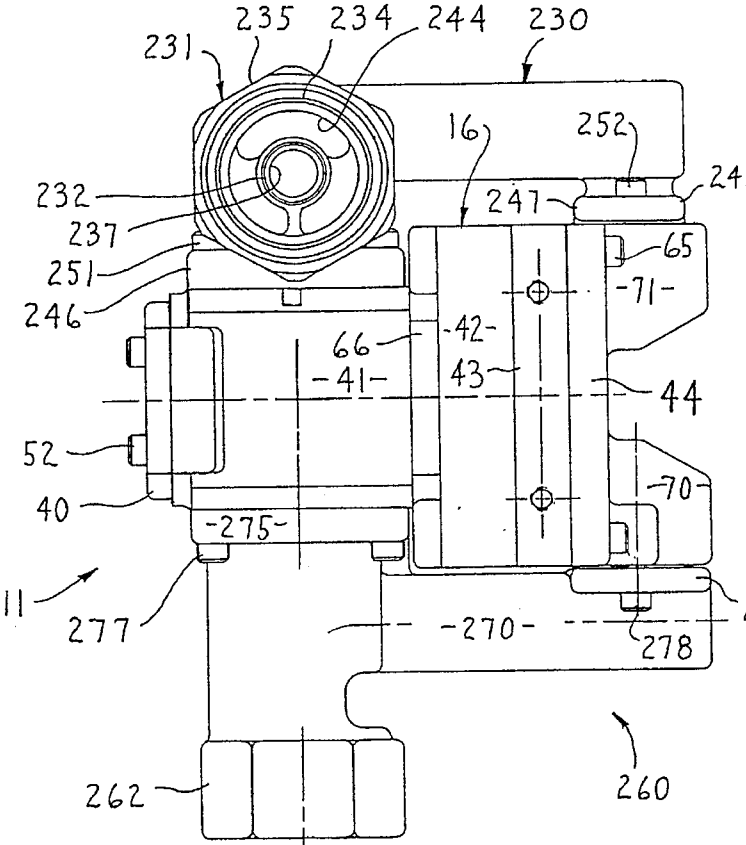
FIG. 9 is a right side elevational view of the FIG. 3 motor/pump unit.

In the housing orientation shown in FIG. 10, the outboard pump head 44 is formed with lower and upper, generally axially protruding, bosses 70 and 71 which respectively extend to the bottom and top of the pump cylinder 43. The vapor inlet and outlet ports 35 and 36 extend axially into the bosses 70 and 71 respectively and turn through 90° downward and upward respectively to end in downward opening and upward opening portion 72 and 73 respectively.

With the housing 16 oriented as shown in FIG. 10, it will be noted that the fuel inlet port 33 and vapor outlet port 36 (in particular the portion 73 thereof) both open upward through the top of the housing, and that the fuel outlet port 34 and vapor inlet port 35 (and more particularly the downward opening portion 72 thereof) both open downward out of the bottom of the housing 16. Thus, the ports to be connected to the pumping and metering unit P/M of the fuel dispenser are on the same housing side (top in FIG. 10) and face in the same direction (up in FIG. 10) from the housing 16. Also, the ports which will connect to the dispensing hose H, and thence to the fueling port FP of the powered vehicle PV (FIG. 1), are on the same side (the bottom in FIG. 10) of the housing 16. Thus, the porting on the housing 16 is arranged for most direct connection to both the pumping and metering unit P/M of the fuel dispenser and the fuel dispensing hose H serving the powered vehicle PV.

For convenience in illustration, the motor and pump vanes 31 and 32 are not shown in FIGS. 4, 8 and 10, and FIGS. 4, 8 and 10 merely show the slots in the rotor assembly where the vanes are to be introduced. The motor vanes 31 are shown in FIGS. 11 and 14–17 and the pump vanes 32 are shown in FIGS. 12 and 18–20.

Figure 8C:
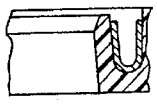
FIG. 8C is a view similar to FIG. 8B but showing a lip seal like that used in the apparatus of prior U.S. Pat. No. 4,295,802.
Figure 8B:
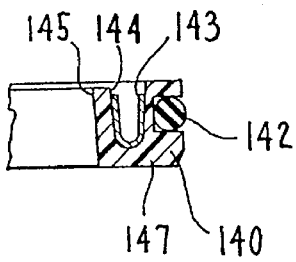
FIG. 8B is an enlarged fragment of the lip seal of FIG. 8A but with the shaft removed.
Figure 8A:
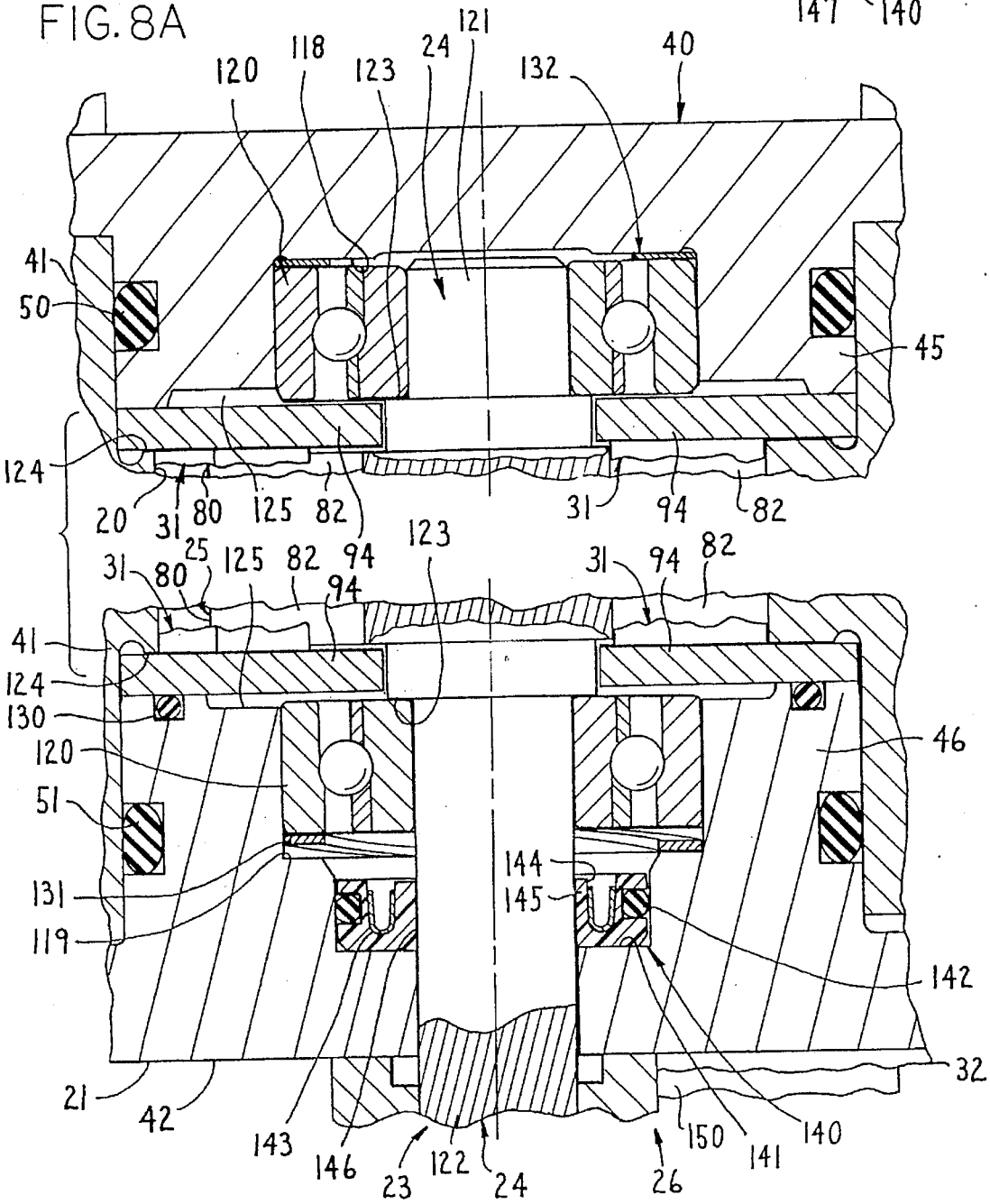
FIG. 8A is an enlarged fragment of FIG. 8.

Turning now to details of the rotor assembly 23 (FIG. 8), the shaft 24 is of maximum diameter within the motor chamber 20 (FIGS. 8 and 11) and there forms a cylindrical carrier 80. In the embodiment shown, the cylindrical carrier 80 is provided with a plurality, here 6, of evenly circumferentially distributed, axially and radially opening, slots 82, in which corresponding vanes 31 are radially slideably received as shown in FIGS. 8A and 11. The axis of the cylindrical carrier 80 is eccentric in the motor chamber 20, to create a moon (crescent) shaped space in the chamber 20. The rightwardmost vane 81 in FIG. 11 thus extends partway out of the cylindrical carrier 80 into the moon-shaped space and into the downward flow of fuel therethrough. Such downward flow of fuel, indicated schematically by the arrows F in FIG. 11, pushes downward on the rightward extending vane 31 to rotate the shaft 24 clockwise in FIG. 11.

Figure 14:
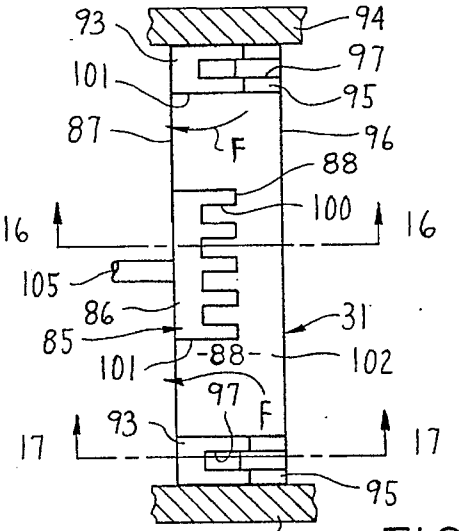
FIG. 14 is a enlarged plan view looking down at the rightwardmost motor impeller blade in FIG. 11.
Figure 15:
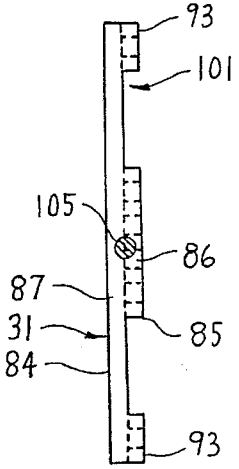
FIG. 15 is an edge view of the FIG. 14 blade taken from the radially inner edge thereof.
Figure 16:
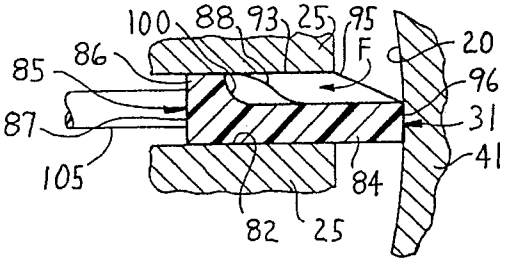
FIG. 16 is an enlarged sectional view substantially taken on the line 16—16 of FIG. 14.
Figure 20:
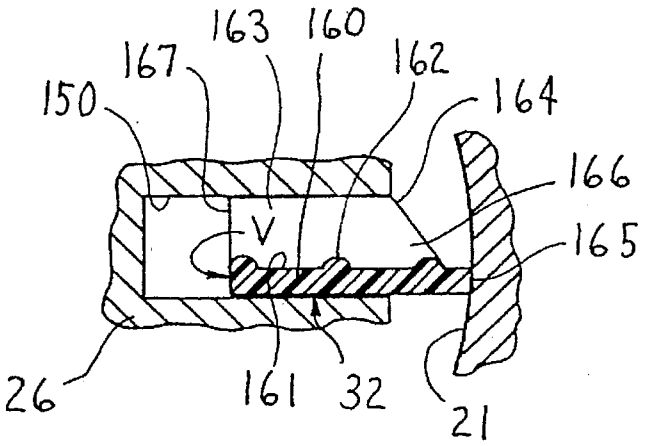
FIG. 20 is a sectional view taken substantially on the line 20—20 of FIG. 18.
Figure 18:
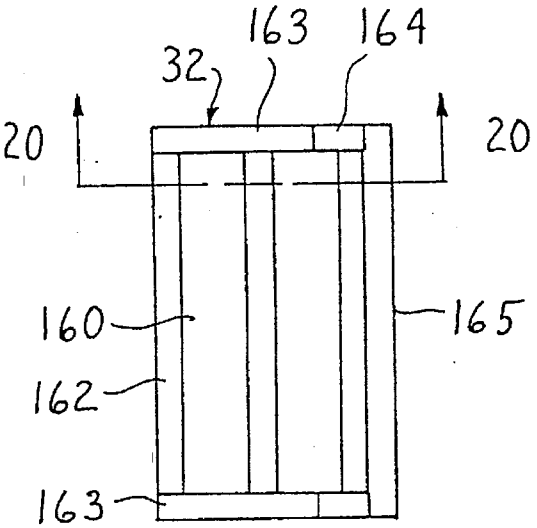
FIG. 18 is a view similar to FIG. 14 but showing the corresponding pump impeller blade of FIG. 12.
Figure 19:
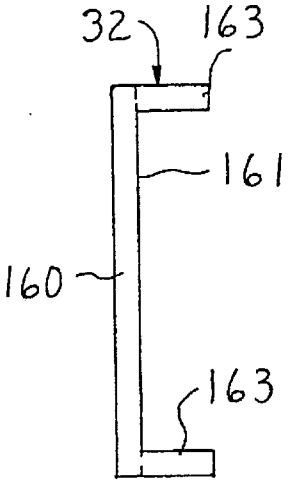
FIG. 19 is an edge view of the FIG. 18 blade taken from the radially inner edge thereof.

Turning now to the special configuration of the vanes 31, attention is directed to FIGS. 14–17. As seen in FIGS. 14 and 15, each vane 31 comprises a substantially rectangular plate 84 having a central comb-shaped boss (hereafter for convenience "the comb") 85 fixed thereon, comprising a base 86 extending along the central part of the radially inner edge 87 of the plate 84 and a plurality (here 5) of tines 88 extending from the base 86 radially outward atop the plate 84 to about the center of width of the plate 84. The term "radial" here refers to the location of the motor vanes 31 with respect to the central axis of the motor impeller 25 in FIG. 11. The tines 88 here have a somewhat rounded profile which slopes from the top of the base 86 to the top of the plate 84, as shown in FIG. 16. The ends of the comb 85 are spaced from the end of the plate 84.

Figure 17:
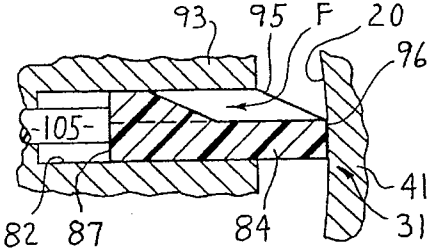
FIG. 17 is an enlarged sectional view substantially taken on the line 17—17 of FIG. 14.

End bosses 93 are provided atop the plate 84 at opposite longitudinal ends thereof. The end bosses 93 provide the ends of the vane 31 with additional, axially facing, slide bearing area for axially bearing against annular plates 94 (FIG. 8) hereafter discussed. The radially outer end 95 of each end boss 93 is tapered as seen in FIG. 17 so as not to increase the thickness of the radially outer edge 96 of the vane 31, so that the thickness of this radially outer contact edge 96 is constant through the entire length of the vane 31 and motor chamber 20.

The end bosses 93 are each further provided with a radially and circumferentially opening groove 97. The grooves 97, and further grooves 100, defined between the tines 88 of the central comb-shaped boss 85, reduce the amount of material required to form the vane 31, and reduce any tendency of the vane to warp during molding and curing, where the vanes 31 are of molded plastics material.

Defined between the central boss 85 and each of the end bosses 93 is a radial channel 101 which permits a free and substantial flow of fuel F radially into the slot 82 and into contact with the radially inner edge 87 of the vane. Thus, the channels 101 allow fuel F to enter freely into, and exit freely radially outwardly from, the zone between the radially inner end of the slot 82 and the radially inner edge 87 of the motor vane 31.

Diametrally slidable push rods 105 (FIGS. 11 and 14–17) extend through diametral openings in the motor impeller 25 between diametrally opposed ones of the motor vane slots 82 to maintain each diametrally opposed pair of motor vanes 31 diametrally far enough apart to locate their radially outer edges 96 closely adjacent to the peripheral wall of the motor chamber 20, in a conventional manner. The motor impeller 25 here has three circumferentially spaced pairs of vanes 31 and so has three such push rods 105. The push rods 105 are preferably all near the axial central portion of the motor impeller 25 but are necessarily slightly axially spaced from each other along the axis of the shaft 24, so as to not physically interfere with each other. In view of the conventional nature of these diametral push rods 105, it is not necessary to show more than one of them in the drawings.

The push rods 105 hold motor vanes 31 adjacent the peripheral wall of the motor chamber 20, generally as seen in FIG. 11 so that fuel F flowing into the fuel inlet port 33 will immediately engage the exposed tips of the rightwardly extending vanes 31 and start rotation of the rotor assembly 23. Incoming fuel from the fuel inlet port 33 strikes the face 102 of the plate 84 of the nearest opposed vane 31 (the face 102 being the face from which the comb 85 and end bosses 93 protrude), and flows radially inward through the channels 101 defined between the comb 85 and end bosses 93 into the radially inner part of the slots 82 and presses radially outward on the radially inner edge 87 of the vane 31 to help push it out in snug sealing relation against the inner peripheral wall of the motor chamber 20. This radially outward hydraulic force is achieved without need for conventional additional fluid channels cut in the material of the motor impeller 25 itself and thus substantially simplifies the structure of the rotor assembly.

The prior U.S. Pat. No. 4,295,802 motor vanes had wear plates built into their radially inner edges to prevent the push rods from digging into the plastic vane material over time. The present invention allows the wear plates to be eliminated.

Rotation of the rotor assembly 23, and with it the vanes 31, results in centrifugal force which further assists in pressing the outer edge 96 of each vane 31 in effective sealing contact with the inner peripheral wall of the motor chamber 20. The motor vanes 31 are preferably of molded plastic material and, with their channels 101 and grooves 97 and 100 and the minimal size of the comb 85 and end bosses 93, are relatively light in weight, and hence pressed less hard against the motor chamber peripheral wall by centrifugal force, as compared for example to the prior relatively heavy block-like vanes of aforementioned U.S. Pat. No. 4,295,802. Indeed, vane overall cross-sectional width and thickness (e.g. the horizontal and vertical dimensions in FIG. 17) of the vanes 31 are much smaller than (roughly half) those dimensions of the vanes of mentioned U.S. Pat. No. 4,295,802, further relatively lightening the vanes 31 of this invention. Thus, the effect of the radially outward pressure of the fuel on the radially inner edge 87 of each vane 31 in the path of the fuel through the moon-shaped space 83 (FIG. 11) is a relatively greater component of the radially outward force pushing the vane in sliding sealing contact with the interior wall of the motor chamber 20, as compared to centrifugal force. Further, these relatively lightweight, molded plastic, skeletonized vanes 31 (e.g. as compared to such U.S. Pat. No. 4,295,802 vanes) tend to press more lightly against the peripheral wall of the motor chamber 20 outside the moon-shaped fuel flow space 83 (namely in the leftward portion of FIG. 11) so as to minimize vane friction with the motor chamber peripheral wall during the "inactive half" of a given rotation. Also, the thickness of the radially outer edge 96 of the vane is substantially less than in the prior U.S. Pat. No. 4,295,802 vanes (in one unit according to the present invention, the outer edge 96 was only about 0.065 inch thick). This thinness of the vane radially outer edge 96 (FIG. 17) advantageously further reduces sliding contact area and friction of the vane with respect to the chamber peripheral surface. This invention benefits from about an 80% drop in vane weight, a 50% drop in sliding surface friction, a 50% increase in manufacturability, and at least a 30% drop in size (about ½ the thickness and 60% the radial width). These features greatly improve the performance of the motor by reducing sliding friction losses, and thereby allow the rotor assembly to turn as freely as possible and impede fuel flow as little as possible while applying adequate torque to the pump impeller 26 to move the required amount of vapor therethrough.

The shaft 24 is supported for rotation as follows. The axially opposed bosses 45 and 46 of the outboard motor head 40 and inboard head 42, are centrally recessed at 118 and 119, respectively, to fixedly mount axially opposed low friction (here ball) bearings 120 (FIGS. 8 and 8A). The shaft 24 has reduced diameter end portions 121 and 122 which are supported for low friction rotation by the ball bearings 120. The shaft 24 between the bearings is of greater diameter than the end portions 121 and 122 and shoulders against the inner races of the bearings 120 to positively axially locate the shaft 24 with respect to the housing 16. The shaft 24 has shoulders 123 which face axially toward and abut against the rotatable inner race of each of the ball bearings 120. Thus, the bearings 120 handle axial and radial thrust loads of the shaft 24 and support the shaft for minimum friction rotation. The bearings 120 are axially located close adjacent the opposite ends of the motor impeller 25 to rigidly rotatably support same against axial and radial dislocation.

The aforementioned annular plates 94 have radially outer portions which are axially fixedly trapped between oppositely axially facing steps 124 (FIG. 8A) of the motor cylinder 41 and the opposing inner ends of the bosses 45 and 46 of the outboard motor head 40 and inboard head 42, respectively. The radially inboard portions of the annular plates 94 are spaced from the shaft and the bearings 120. The annular plates 94 provide a smooth surface for ends of the rotating vanes 31 to circumferentially slide against. Only the vanes 31 can make contact with these annular plates 94. The annular plates 94 are spaced apart axially sufficient to establish a small axial running clearance (for example about 0.003 inch) between each thrust plate 94 and the opposed end of the vanes 31 and cylindrical carrier 80. Shallow annular reliefs 125, radially just outboard of the bearings 120, in the inboard ends of the bosses 45 and 46, back the annular plates 94 and avoid possible minor bulges in the opposed ends of the bosses 45 and 46, namely bulges that might accidentally push the annular plates closer to each other, and hence closer to the vanes 31 and carrier 80, than intended. In other words, the presence of the annular reliefs 125 assures that axial location of the thrust plates 94 will be controlled by abutment thereof by the radially outermost portion of the bosses 45 and 46. The inner peripheral portion of the inner plates 94 lies between the cylindrical carrier 80 and the opposed bearings 120.

A resilient O-ring 130 is radially located concentrically in the free axial end of the boss 46 and presses axially against the opposed thrust plate 94 to make up for minor manufacturing clearances, so that the annular steps 124 in the motor cylinder 41 bear on and determine the separation between the annular plates 94. Thus, the O-ring 130 acts not as a seal, but rather as an axial compression spring.

The bearing recess 119 in the boss 46, has extra axial depth for receiving therein, in partially axially compressed relation, a generally circular wave spring 131. The wave spring 131 is partially resiliently compressed axially between the closed end of the recess 119 and the radially outer race of the bearing 120 in the boss 46, so as to apply a light axial loading force (for example about 4–6 pounds), through the outer race and balls and inner race of the inboard bearing 120, the shaft 24, the inner race and balls of the outboard bearing 120 in the boss 45, to press the outer race of such outboard bearing 120 against a suitable thickness shim backed by the outboard motor head 40, to precisely axially position the shaft and thereby the cylindrical carrier 80 and motor vanes 31 with respect to the thrust plates 94.

A clearance recess 135 (FIG. 8) is provided in the center of the interior face of the outboard pump head 44. The clearance recess 135 is of diameter larger than the adjacent end of the shaft 24. The adjacent end of the shaft 24 can enter the clearance recess 135 and thus avoid contact with the outboard pump head 44, if stacking of manufacturing tolerances of the housing elements 40, 41, 42, 43 and 44 is somewhat less in total axial length than usual.

A lip seal 140 (FIG. 8A) is fixedly in a sub-recess 141 in the inboard head 42. The sub-recess 141 opens radially into the shaft portion 122 and axially into the wave spring recess 119 and is of diameter less than that of the wave spring recess 119. The lip seal 140 is of a relatively hard, wear resistant, yet somewhat bendable material. The lip seal 140 is of a generally square cross-section modified by a radially outward facing annular groove which houses a resilient O-ring seal 142 which provides a static seal against the radially outer wall of the sub-recess 141 and prevents leakage of fuel therepast. The generally square cross-section of the lip seal 140 is also modified by an annular groove 144 which faces axially toward the recess 119 and receives a generally U-cross-section annular spring member (hereafter "U-section spring") 143. The axially facing annular groove 144 leaves an annular lip 145 radially inboard thereof, which lip 145 is resiliently pressed radially into annular sealing contact with the rotating shaft portion 122, by the radially inward force of the U-section spring 143. FIGS. 8A and 8B show the lip 145 in its shaft engaging and radially inward angled free positions respectively. The shaft portion 122, at least in the area engaged by the lip 145, is finished especially hard and smooth, for example by providing a chrome oxide coating thereon, as generally indicated by the reference numeral 146.

The lip seal 140 prevents fuel leakage therepast of fuel from the motor chamber 20 into the pump chamber 21, whether or not the shaft 24 is rotating. The chrome oxide coating 146 prolongs the working life of the lip seal 140 and helps minimize leakage past the annular lip 145.

The O-ring 142 permits the body 147 of the lip seal 140 to be of optimal shape and material to carry out the sealing duty of its annular lip 145 against the rotating shaft 24, without having to be compromised in any way to effect a static seal against the boss 46. The O-ring 142 can thus be for example, a softer gummier material that would be appropriate for the lip 145.

As a result of the above discussed features of the lip seal 140 and especially hardened and smoothed portion 146 of the shaft by the lip 145, only one such seal 140 is needed axially between the chambers 20 and 21. This contrasts with the prior apparatus of above-discussed U.S. Pat. No. 4,295,802, which requires two lip seals interposed between the motor and pumping chambers, namely two lip seals of the different shape shown in FIG. 8C and which allowed more leak by than in the present invention which has non-measurable leak by. The prior apparatus does not use any chrome oxide shaft coating. The result is that the structure, immediately above-described at 140–147 in FIGS. 8A and 8B, non-measurable leak by, long seal life, and reduces shaft running friction and thus requires less kinetic energy from the fuel flowing through the motor chamber and hence results in less drop in fuel flow rate, of fuel turning the motor impeller 25.

Due to the small scale of FIGS. 4, 8 and 10, the wave spring 131 and lip seal 140 are not shown therein.

The pump chamber 21 and impeller 26 are axially shorter but of greater diameter than the motor chamber 20 and impeller 25. The pump impeller 26 (FIG. 12 and 8A) comprises a substantially circular cylindrical body having a plurality, here 4, of evenly circumferentially spaced, radially and axially opening, substantially rectangular cross-section slots 150 for radially slidably receiving the pump vanes 32. The pump impeller body is fixed on the shaft 24 by any conventional means not shown. To reduce the mass and rotating inertia, as well as to save material, the body of the pump impeller 26 is here provided with generally pie-shaped cross-section, axially opening holes 151 (FIG. 12).

The pump vanes 32 are preferably of molded plastic material (like the motor vanes 31). Further, the pump vanes 32 are also of a skeletonized construction, which contrast with the block-like pump vanes of aforementioned U.S. Pat. No. 4,295,802. More particularly, the pump vanes 32 (FIGS. 18–20) each comprise a substantially rectangular plate 160. The upper (in FIG. 20 and in the orientation of the rightwardmost vane 32 in FIG. 12) face 161 of the vane has radially spaced, axially extending, semi-circular ribs 162, and a pair of upstanding end plates 163. The ribs 162 keep the vane plate 160 from warping, e.g. curling along its length dimension, thereby avoiding vapor leakage around the vane in use. The end plates 163 have tapered radially outer edges 164 which extend radially outward almost, but not quite, to the radially outer edge 165 of the plate 160. The radially outer edge 165 extends axially and is arranged to bear lightly and slidingly against the inner circumferential wall of the pump chamber 21 as the shaft rotates.

The combined circumferential height of the plate 160 and end plates 163, plus a modest circumferential clearance, equals the circumferential width of the vane slots 150. The radial length of the end plates 163 exceeds the circumferential width of the vane slots 150 so that the end plates 163 reliably guide, without jamming, radially inward and outward sliding of the vanes 32 in the slots 150.

The ribbed face 161 of the plate 160 faces the incoming vapor V (see the bottom-most vane 32 in FIG. 12) and thus tends to scoop a portion of the incoming vapor V radially inward through the channel 166 defined across the ribbed face 161 of the plate 160 and axially between the end plates 163, to bring vapor V into the radially inner portion of the slot 150 to provide some degree of vapor pressure bearing on and pressing radially outward against the radially inner edge 167 of the vane 32 as the pump impeller 26 is rotated by the motor impeller 25. Thus, during rotation of the pump impeller 26, this vapor pressure and centrifugal force lightly radially outwardly urge the vanes 32 into a light sliding seal contact with the periphery of the pump chamber 21. The centrifugal force pushing the vane radially outward tends to be relatively light in view of the skeletonized, lightweight configuration of the pump vanes 32. Thus, the pump vanes 32 have much the same advantages as the motor vanes 31 above-described, and indeed a further advantage - namely that (unlike in the prior U.S. Pat. No. 4,295,802 device) the inventive pump impeller 26 eliminates push rods. Accordingly, an efficient, relatively vapor tight, running seal is created between the radially outward edge 165 of the pump vanes 32 and the inner peripheral wall of the pump chamber 21 but with only light sliding friction therebetween for relatively free rotation of the pump impeller 26 and thus minimum drop in flow rate of fuel F driving the motor impeller 25.

A preferred plastic material from which the vanes can be made is a polyphenyl sulfide (PPS) material, which has the qualities of hardness and high tensile and flexural strength; good mechanical properties at elevated temperatures; non-responsiveness to relatively high temperatures (continuous service capability up to at least 350° fahrenheit); stress crack resistance; resistance to mineral acids, bases, salt solutions, detergents, hydrocarbon oils and aliphatic hydrocarbons; and ability to be molded in a variety of shapes. In particular, this material is not affected by any type of gasoline or any types of blended gasolines. The vane material is preferably carbon filled to give the vanes dielectric properties that assure no static electricity build up.

Figure 11A:
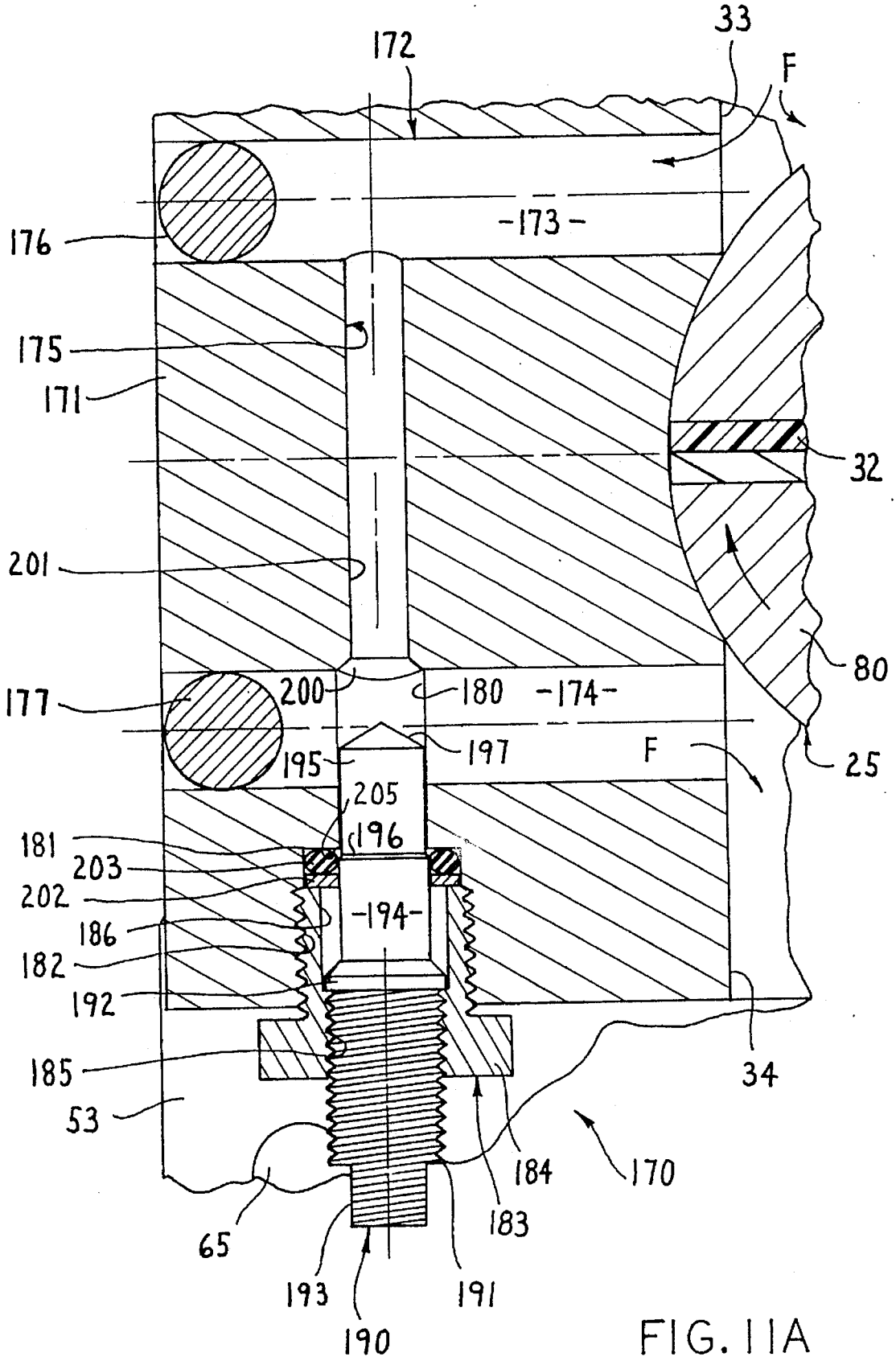
FIG. 11A is an enlarged fragment of FIG. 11, but with the bypass valve open.
Figure 11:
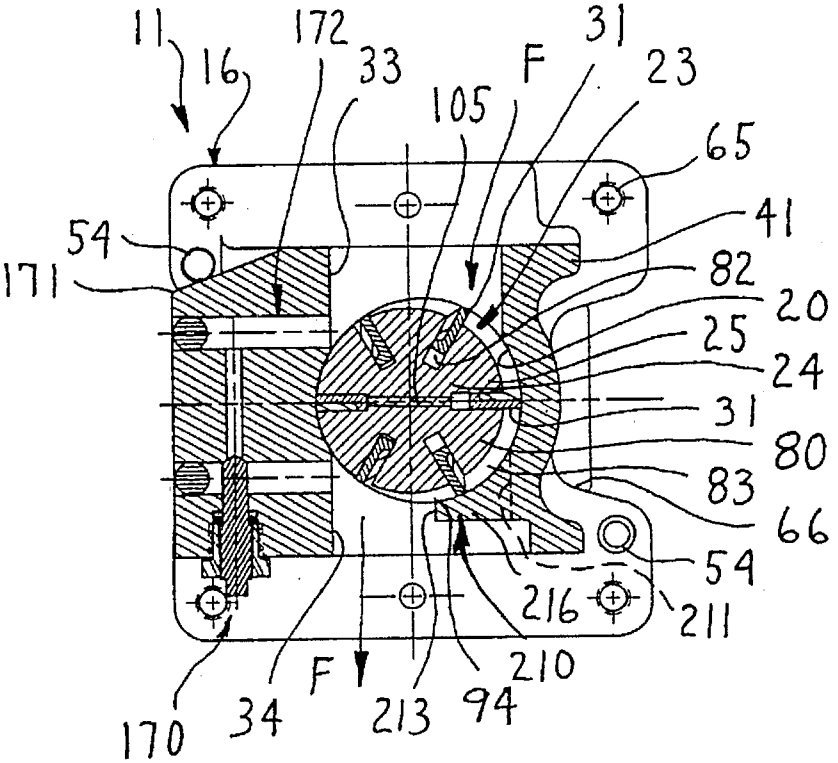
FIG. 11 is a sectional view substantially taken on line 11—11 of FIG. 4 and showing a fill bypass passage around the motor chamber.

Attention is now directed to FIGS. 11 and 11A which disclose a bypass unit 170. It is desirable to be able to adjust the pumping capacity (vapor flow rate) of the apparatus 10. For example, fuel refineries vary the volatility of gasoline to compensate for engine starting and running conditions, as between relatively cold winter temperatures and relatively warm summer temperatures encountered in, for example, the northern part of the United States. Where less than maximum vapor pumping capability is required, it is desirable to be able to reduce same, for example, to avoid ingesting excess air during fueling thus avoid unwanted pressurizing of the underground fuel storage tank ST, and to minimize the amount of kinetic energy taken from the fuel flowing through the motor chamber 20 (and thereby minimize the drop in fuel flow rate) due to the presence of the motor/pumping unit 11 (FIG. 1) between the dispenser P/M and vehicle fuel port FP.

To this end, the vapor recovery motor/pump unit 11 includes the bypass unit 170 (FIGS. 11 and 11A). The bypass unit 170 is housed in a ridge 171 which, in its orientation in FIG. 3, is elongate vertically and protrudes leftwardly from the motor cylinder 41. As seen in FIGS. 5 and 6, the ridge 171 is substantially centered along the length of the motor cylinder 41. The bypass unit 170 (FIGS. 8A) comprises a generally U-shaped bypass passage 172, disposed in the ridge 171 and connecting the fuel inlet port 33 to the fuel outlet port 34, here at the side of the motor chamber 20 where the motor impeller 25 comes closest to the peripheral wall of the motor chamber 20 (the side of the motor chamber 20 furthest from and diametrally opposed to the moon-shaped space 83 of FIG. 11). In the embodiment shown, the bypass passage 172 is conveniently formed by horizontal upper and lower (in FIG. 11A) bores 173 and 174 respectively open to the fuel inlet and outlet ports 33 and 34 and connected by a vertical bore 175 which opens through the bottom of the ridge 171 and extends up through the mid-portion of lower bore 174 and up into communication with the mid-portion of upper bore 173. The outboard (leftward in FIG. 11A) ends of the horizontal bores 173 and 174 are closed by any convenient means such as the fixedly pressed in balls 176 and 177.

The vertical bore 175 opens downward through a series of progressively larger diameter recesses (upper, mid and lower) 180, 181 and 182. The lower recess 182 is internally threaded to receive an externally threaded hollow tubular screw 183 in response to rotation of such screw by means of its radially enlarged, tool engageable head 184. The hollow tubular screw 183 has a coaxial through hole internally threaded at its lower end portion as indicated at 185 and having an enlarged diameter, upward opening, recessed, upper portion 186 above the threaded lower end 185.

A needle valve member 190 has an externally threaded lower portion 191 insertable down through the recess 186 and threadable down through the threaded lower end 185 of the tubular screw 183. An annular ridge 192 on the needle valve member 190 lies at the top of the threaded portion 191. The annular ridge 192 is of small enough diameter to axially slide down into the recessed upper portion 186 of the tubular screw 183, but cannot enter the threaded lower end 185. Thus, the annular ridge 192 positively prevents the needle valve member 190 from being threaded downwardly entirely out of the tubular screw 183. Thus, a person adjusting the needle valve member cannot accidentally thread it out of hollow screw 183 and thereby accidentally open the fuel bypass passage 172 to the atmosphere. The bypass unit 170 may thus be termed "fail-safe".

The bottom extremity of the needle valve member 190 is provided with means engageable by a tool for threading such needle valve member 190 up and down within the hollow tubular screw 183. In the embodiment shown, the lower extremity of the needle valve member simply has cut therein a diametrally opposed pair of flats 193 engageable by a wrench, which flats 193 do not interfere with assembly of the needle valve member 190 downward into the recessed upper end of the tubular screw 183 prior to insertion of such screw into the ridge 171.

The needle valve member 190, above its annular ridge 192, comprises intermediate and upper, circular cross-section, cylindrical portions 194 and 195, separated by a shallow, up facing, annular step 196. The upper cylindrical portion 195 terminates at its upper end in a conical valve tip 197.

The needle valve member 190 is shown in FIG. 11A in its fully opened position. The needle valve member 190 is threadable upward with respect to the tubular screw 183 to bring its upward facing conical valve tip 197 upward diametrally across the lower bypass bore 174 and into sealing contact with a downward facing frustoconical valve seat 200, which joins the upper recess 180 to the reduced diameter upper portion of the vertical bore 175. Axial threading of the needle valve member 190 toward and away from the seat 200 determines the effective fuel flow rate through the bypass passage 172 and around the motor chamber 20. Thus, progressive opening of the bypass passage 172, by downward threading of the needle valve member 190 away from the seat 200, progressively reduces fuel flow through the half-moon shaped space 183 (FIG. 11) to the right of the cylindrical carrier 80 of the motor impeller 25, thereby reducing the rotative speed of the rotor assembly 23 and the vapor pumping rate of the vapor pump impeller 26.

Fuel leakage out of the bypass passage 172, axially down along the needle valve member and hollow tubular screw 183, is prevented by a two-part seal structure, as follows.

An annular washer 202 sleeves snugly but slidably over the intermediate cylindrical portion 194 of the needle valve member 190 and is snugly but axially slideably receivable in the mid-recess 181. An O-ring 203 is supported atop the washer 202 and fits snugly within the mid-recess 181. With the needle valve member 190 fully threaded downward (open) as shown in FIG. 11A, the washer 202 and O-ring 203 snugly surround the intermediate cylindrical portion 194 of the valve member 190.

With the hollow screw 183 fully threaded into and tightened in the internally threaded lower recess 182 as shown in FIG. 11A, the upper end of the tubular screw 183 acts through the washer 202 and O-ring 203 against a downward facing radial seat 205 connecting the upper and mid-recesses 180 and 181. More particularly, final tightening of the hollow screw 183 in the ridge 171 axially compresses the O-ring 203 between the washer 202 and seat 205, thereby radially expanding the O-ring to press same radially firmly against the needle valve member 190 and the inner surface of the mid-recess 181 in the ridge 171. This prevents any passage of fuel downward between the needle valve member 190 (be it open or closed) and the surrounding portion of the ridge 171.

Having discussed above the internal components of the motor/pump unit 11, attention is now directed in more detail to the provision for fuel flow to and from the housing 16. Applicant has noted a special problem in motor/pump units of this general kind and which is to be overcome by the present invention. More particularly, Applicant has noted that fuel passing through the motor chamber 20 tends to press the radially outer edges of the vanes 31 with additional force against the inner peripheral wall of the chamber adjacent the edges of the outlet port. Applicant has thus noted that, a portion of the outer edge of a vane will pass across the opening of the fuel outlet port and receive relatively little wear, as compared to axially adjacent portions of the outer vane edge, which slide along the motor chamber peripheral wall axially bounding such outlet port. The result, over an extended period of use, would normally be uneven wear of the radially outer edge of the vanes and premature failure, necessitating early discarding of the pump/motor unit, which is undesirable. Such a worn blade tends to ride through most of the rotative movement on the relatively little worn central portion of its radially outer edge, the rest of the vane outer edge, usually the axially outer outboard portions thereof, being worn and thus gaped from the motor housing peripheral wall, and thereby allowing excess leakage of fuel therepast. Thus, some of the fuel, intended to rotate the motor impeller, unintentionally bypasses it instead, thereby undesirably reducing the motor torque and speed.

Indeed, in prior fuel powered motors of which we are aware inlet and outlet ports had to be directed axially of the shaft not radially as in the present invention, because of the critical vane wear problem that occurred. The present invention solves the vane wear problem, thus allowing the much more efficient radially directed fuel inlet and outlet ports.

As seen in FIGS. 6, 10 and 11, there is radially interposed between the outlet port 34 and the motor chamber 20, a webwork 210 (FIG. 6). The webwork 210 circumferentially continues the inner peripheral wall of the chamber 20 in the form of webs 214, 215 and 216 separated by plural holes 211, 212 and 213. The webs 214–216 form a generally Y-shaped webwork with the base of the Y (at 216) separating the symmetrically opposed, generally triangular holes 211 and 212. The webs 214 and 215, forming the arms of the Y, are disposed between the hypotenuse sides of the respective triangular holes 211 and 212 and adjacent sides of the generally diamond shaped hole 213. The corners of all the holes 211, 212 and 213 are rounded as shown in FIG. 6, to further reduce the wear on the radially outer edges 96 (FIG. 16) of the motor vanes 31. It will be seen from FIG. 6 that all portions of the radially outer edge of a motor vane will be supported for at least part of the vane as it sweeps across the outlet port 34 by one or more of the webs. Further, it will be seen from FIG. 6 that adjacent portions of the radially outer vane edge will pass over about the same total circumferential length of hole. For example, the axial center of the vane passes over the longest circumferential width of the diamond shaped hole 213 but avoids the holes 211 and 212, whereas another part of the vane passes over the maximum circumferential width of the triangular hole 211 while entirely avoiding the diamond shaped hole 213, and whereas another part of the vane passes across circumferentially shorter portions of both the triangular shaped hole 211 and diamond shaped hole 213. Thus, no point on the radially outer edge of a vane spends substantially more time unsupported in the outlet port than some adjacent point. Further, the holes 211–213 taper, or converge, in the direction of circumferential vane travel such that an outboard vane edge becomes better and better supported, in a gradual manner, as it sweeps circumferentially across the final portion of the outlet port 34. Further, the maximum axial extent of unsupported radially outer vane edge, permitted by the web work 210, is much less than the diameter of the fuel outlet port 34. Thus, a lighter, less rigid, more easily bendable vane can be used. Thus, the web work 10 makes practical the relatively thin, lightweight vanes 31 above-discussed with respect to FIGS. 14–17.

Thus, it will be seen that no point on the radially outer edge of each vane 31 is unsupported across the full circumferential width of fuel outlet port 34. Still, the holes 211–213 between the webs 214–216 allow relatively free fuel outlet flow from said motor chamber therethrough.

The fuel outlet port 34 is offset sideways (FIGS. 6 and 11) of the motor impeller rotational axis and toward the generally crescent-shaped cross-section fuel flow space 83. The fuel outlet 34 is of greatest effective width, defined by the total maximum width of the triangular holes 211 and 212 adjacent their bases, at its circumferential end underlying the crescent-shaped cross-section, fuel flow space 83. The maximum fuel pressure between vanes 34 in the crescent space 83 tends to occur in the bottom (FIG. 11) half, where the crescent starts to narrow, and "pinch", which is just before the leading vane 34 sweeps onto web 216 and over the effective widest portion (the triangular hole 211, 212 base portions) of the outlet port 34. These features cooperate for causing fuel trapped between the vanes 34 to quickly dump, from the bottom half of the crescent space 83 directly down through the triangular fuel outlet holes 211, 212, particularly through the wide base portions of such generally triangular holes. The last of such trapped fuel squeezes out through the far (left in FIGS. 6 and 11) narrow end of the generally diamond-shaped hole 213. These features minimize loss of kinetic energy in fuel passing from the crescent space 83 down through the fuel outlet 34.

Just as the fuel F rotating the motor impeller 25 tends to push the radially outboard edge of each motor vane hard against the peripheral wall of the motor chamber 20 at the outlet port 34, the same fuel flow tends to push the radially outer edges 96 of the vanes away from the fuel inlet port 33. Accordingly, the fuel inlet port 33 here comprises a single hole, without web work comparable to that above-discussed at 210. In the embodiment shown, the inlet port 33 is circumferentially somewhat elongate, having a perimeter somewhat like the profile of a pear.

The fuel inlet port 33 is offset sidewardly to the right in FIGS. 5 and 11 of the motor impeller rotational axis, namely toward crescent-shaped cross-section, fuel flow space 83. Also, the fuel inlet port 33 is wider (in a direction parallel to the shaft axis) at its circumferential end over the crescent space 83. These features cause the fuel inlet to direct fuel straight down, mostly against the upper vane 31 in the upper right (FIG. 5) quarter of the crescent space 83. These features maximize application of fuel kinetic energy to rotating the motor impeller 25. Thus, the path of the fuel through the housing 16 thus is as unrestricted and straight (bend-free) as possible, so that any reduction in fuel flow rate through the motor/pump unit 11 will, to the extent possible, be converted to rotation of the rotor assembly 23.

The housing 16 is adapted to alternatively receive a variety of different inlet and outlet manifolds. For example, in the embodiment shown in FIGS. 1–3 and 7, 9 and 10, the housing 16, in its orientation shown in the drawings, has fixed to the top thereof a combined fuel in/vapor out manifold 230, here including a 90° (and in FIGS. 1 and 3 horizontal rightward facing) connector 231 of conventional type adapted to connect directly with a popular type of conventional pumping and metering unit P/M. For convenience, the particular manifold 230 may be referred to as a 90° fuel/vapor combination manifold, in the following discussion.

In the embodiment shown, the pumping and metering unit P/M is of the common type providing an annular vapor passage vase surrounding a central fuel passage F. In the past, the outer annular vapor passage and central fuel passage arrangement has extended to the hose and fuel flow controller which extend to the vehicle PV to be fueled. This arrangement has been referred to in the trade as being of "coaxial" style of passage arrangement. However, such "coaxial" style hoses have had some associated problems and such has led to providing hoses referred to in the trade as "inverted", wherein the annular passage is used for fuel and the central passage for vapor, in the manner above-discussed with respect to the hose H of FIG. 1. Since in both styles of hose, one passage lies within the other and may be coaxial therewith, geometrically speaking, the industry terms of "coaxial" and "inverted" are avoided in the following discussion, in favor of more descriptive terminology, such as "center fuel/outer vapor" and "center vapor/outer fuel" hoses and connectors.

The apparatus of FIGS. 1–10 may be provided with manifold structure, hereafter discussed, which advantageously makes the conversion from a center fuel/outer vapor style unit P/M, of the kind existing in many gasoline dispensing stations, to the newer inner vapor/outer fuel style hose H in FIG. 1.

Returning to the conventional connector 231, same has a central tubular stub 232 (FIG. 3) extending from an annular, surrounding, coaxial coupler 234. A faceted, wrench engageable, tightenable ring 235 is axially fixed by a snap ring 229 on, but rotatable with respect to, the annular coupler 234, in surrounding relation thereon, and is provided with external threads 236 and an O-ring 233. The connector 231 is of commonly used type, and is complementary to and connectable in sealed, fuel and vapor conducting relation to a corresponding fitting (not shown) on the pumping and metering unit P/M.

The manifold 230 supports the connector 231. The fuel receiving, central tubular stub 232 of the connector 231 connects through a substantially right angle passage in the manifold 230, as schematically indicated in dotted line at 237 in FIG. 3, and then downwardly through a flaring passage 238 (FIG. 10) to the top of the fuel inlet port 33 of the housing 16. The passages 237 and 238 thus minimize flow restriction to incoming fuel F entering the motor chamber 20.

In contrast, it is the vapor that is left with the longer and more complex path through the manifold 230. More particularly, vapor from the upward opening portion 73 (FIG. 10) of the vapor outlet port 36 flows upward through an upward vapor leg 242 of the manifold 230 and then rightwardly (FIG. 10) along an elongate lateral vapor leg 243 and thence through a horizontal right angle into a part annular passage 244 (FIGS. 9 and 10) communicating with the annular coupler 234. The hollow tubular legs 242 and 243 define a vapor path which is substantially longer than and more restrictive than the fuel flow path 237, 238 in the manifold 230. The left (FIG. 10) end of the passage in the lateral leg 243 is closed, as by a conventional threaded plug 245.

The manifold 230 is fixed to the housing 16, preferably removably. More particularly, the manifold 230 has a pair of horizontal mounting flanges 246 and 247, respectively located at the bottom of the upstanding fuel leg 250 (which houses the flaring passage 238) and upstanding vapor leg 242. Screws 251 and 252 (FIG. 9) removably fix the flanges 246 and 247 to the housing 16. The flanges may be sealed, against fluid leakage, to the housing 16 by any convenient means, such as annular O-ring seals located in grooves in the bottom faces of the flanges 246 and 247.

In the embodiment shown in FIGS. 1–10, there is provided a "fuel out/vapor in" manifold 260 which, in the orientation of the housing 16 shown in FIGS. 1–10, is fixed to the bottom of such housing and extends downward therefrom. The manifold 260 comprises a relatively large diameter fuel outlet passage 261 (FIG. 10) which depends coaxially downward from the fuel outlet port 34 of the housing 16 and is of substantially the same or preferably slightly larger (as here shown in FIG. 10) diameter.

The bottom end of the passage 261 opens downward and is arranged for connection to the annular fuel passage 12 of the hose H. In the particular embodiment shown, the bottom of the fuel outlet passage defines a conventional female fuel fitting 262 which is internally threaded at 263 to conventionally receive a conventional male fuel fitting 264 at the adjacent end of the hose H. The male fitting 264 may, for example, be similar to the connector above-discussed at 231 in FIG. 3. Thus, in the embodiment shown, the male fitting 264 comprises a wrench engageable head 265, annular seal 266 for sealing against the inside of the female fitting 262 just below the threads 263, and external threads 268 engageable with the internal threads 263.

The manifold 260 further comprises a horizontal leg 270 including a vapor passage 271 running from the vapor inlet port 35 down into the manifold passage 271 and thence rightwardly (in FIG. 10) toward and into the fuel outlet passage 261. More particularly, the leg 270 protrudes into the fuel outlet passage 261 and then bends downward to terminate in a downwardly opening vapor inlet recess 272, which is close spaced above the female threads 263 of the fuel outlet passage 261. Thus, in view of the rightward protrusion thereinto of the downwardly bent leg 270, the cross-section of the fuel outlet passage 261, at the height of the recess 272, is substantially U-shaped. The recess 272 is sized to snugly and sealingly receive axially thereinto the upward protruding coaxial vapor carrying tubular stub 273. A seal ring 274 fixed on the tubular stub 273 seals against the peripheral wall of the vapor recess 272. The tubular stub 273 is a coaxial extension of the vapor passage 13 of the hose H. Thus, upon insertion of the tubular stub 273 into the vapor recess 272, and threading of the male fitting 264 into the female fuel fitting 262, the fuel and vapor passages 12 and 13 of the hose H are connected in a leak free manner to the fuel outlet port 34 and vapor inlet port 35, respectively, by the manifold 270. For minimum interference with fuel flow, fuel flow through the manifold 260 is straight downward out of the motor chamber 20, and it is the much lighter, and hence lower inertia, vapor V which is required to turn, and indeed turn several times, in flowing from hose H to vapor pump chamber 21. Applicant has noted that vapor can make more turns with very minute losses. Liquid cannot without substantial pressure losses.

The manifold 260 is fixed to the housing 16 by any convenient means, here comprising flanges 275 and 276 (FIG. 9) fixed to the opposed faces of the housing 16 by screws 277 and 278 respectively, much as with the manifold 230 above described. Further, seal rings are preferably provided in the faces of the flanges 275 and 276 to sealingly engage the opposed face of the housing 16 in a manner to prevent leakage of fuel or vapor where the fuel and vapor passages 261 and 271 communicate with the corresponding ports 34 and 35. As with the leftward end of the manifold 230, the leftward end (FIG. 10) of the vapor passage 271 in the manifold 260 is closed by any convenient means, such as a threaded plug 279.

Figure 21:
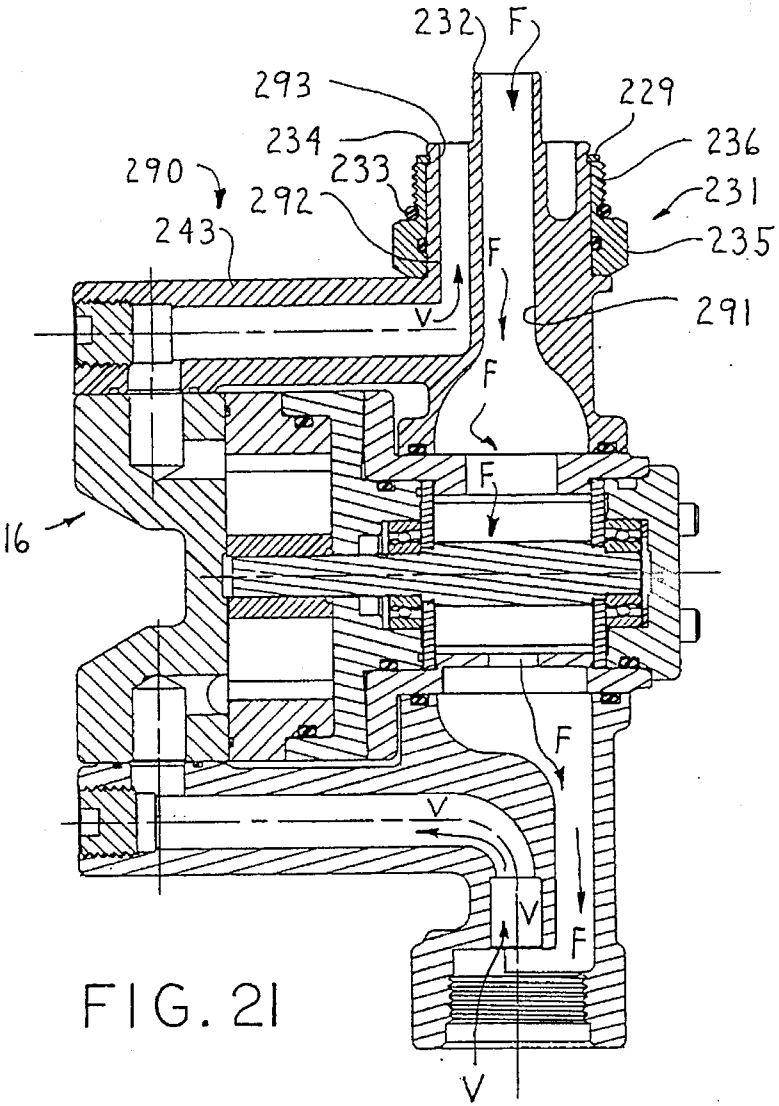
FIG. 21 is a central cross-sectional view similar to FIG. 10 but showing a modified fuel inlet and vapor outlet combination manifold.

FIG. 21 shows a modified upper "fuel in/vapor out" style manifold 290, which is similar to the manifold 230 except for the following differences.

Instead of angling into the page, as in the manifold 230 of FIG. 10, the manifold 290 has its fuel passage 291 extending straight up into the tubular stub 232 to receive fuel F from above. Similarly, in the modified manifold 290, the lateral vapor leg 243 bends upward at 292 to merge into a vapor outlet 293 annularly surrounding the tubular stub 232.

Figure 22:
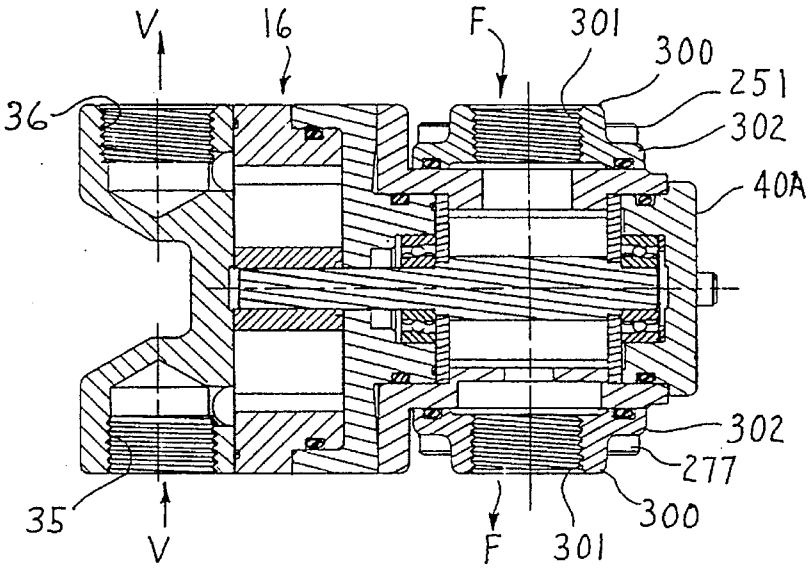
FIG. 22 is a central cross-sectional view similar to FIG. 10 but showing individual fuel inlet and outlet fittings.

It is also possible to substitute, for the kind of combination fuel/vapor manifolds discussed above, individual fuel fittings. Thus, for example, in FIG. 22, both the upper and lower manifolds are replaced by similar individual fuel fittings 300. In the embodiment shown, the fittings are annular, internally threaded (at 301) members capable of threadably receiving a male fuel hose fitting (much like the FIG. 10 fitting 264 except without the central vapor handling parts 273, 274 and 13). The fittings 300 have radial flanges 302 for fixing to the housing 16, for example by the same screws 251 and 277 used to secure the manifolds 230 and 260, respectively. When using the fittings 300 for the fuel side of the housing 16, any convenient and conventional means (not shown) may be used to connect to the vapor inlet and outlet ports 35 and 36, respectively. Vapor inlet and outlet ports 35 and 36 may be of various types (for example, the FIG. 10 unthreaded ports or the FIG. 22 threaded ports), and same can be changed by substituting a different outboard pump head 44.

It is contemplated that manifolds and fittings of various kinds, including (but not limited to) the above-described manifolds 230, 260 and 290 and fittings 300 can be mixed and matched to adapt the motor/pump unit 11 to the various dispenser/plumbing systems presently installed in the field.

FIGS. 23–27 disclose a further modification in which a single housing part is substituted for several individual housing parts of FIG. 2. More particularly, in FIG. 23, a vapor pump cup 310 has corner flanges 311 having a coplanar face 312 adapted to abut the inboard radial flange 53 of the motor cylinder 41 of FIG. 4, in the absence of the inboard head 42, pump cylinder 43 and outboard pump head 44 of FIG. 4. Screws 313 pass through threaded holes in the corners of one of the flanges 311 and 53 and thread into the threaded holes in the other of such flanges to affix the cup 310 to the motor cylinder 41. A recess 314 in the cup 310 snugly receives a circular cylindrical liner 315 (FIGS. 23 and 26) pierced by a large, approximately circular, through hole which defines the pump chamber 316, comparable to the pump chamber 21 above-described with respect to FIGS. 4 and 8. An axial pin 317 extends axially, in fixed relation from the cup end wall 320, into the liner 315, to positively prevent rotation of the liner 315 within the cup 310. An inboard bulkhead 321, provided in place of the inboard head 42 of FIG. 4, comprises a circular disk 322 having a circular boss 323 extending coaxially therefrom toward the motor chamber and away from the pump chamber 316. The disk 322 and boss 323 are annularly grooved in their cylindrical circular peripheries for reception of sealing rings 324 and 325. The total axial extent of the liner 315 and disk 322 correspond substantially to the axial depth of the cup recess 314, as seen in FIG. 23, such that the seal ring 324 on the disk 322 prevents axial seepage of vapor therepast from the pump chamber 316 toward the vapor chamber enclosed within the pump cylinder 41. The seal ring 325 is positioned like, and serves the purpose of, the seal ring 51 of FIG. 4. The central portion of the disk 322 and its attached boss 323 are configured like the annular recess 119 and subrecess 141 of FIG. 8A and are provided for the purpose of receiving the FIG. 8A lower bearing 120 and lip seal 140.

The remainder of the FIG. 23 apparatus, axially connecting to the lower (in FIG. 23) portion of the apparatus shown, may be as discussed above with respect to FIG. 8A and FIGS. 4 and 8.

It is instructive to compare certain structural and operational aspects, listed below, of a new unit constructed according to the present invention and old unit constructed to according above-mentioned U.S. Pat. No. 4,295,802. For convenience, in the tables below the new unit according to the present invention is designated "VRF" and the old unit according to aforementioned U.S. Pat. No. 4,295,802 is designated "VR". Despite the differences set forth in the tables below, the old VR unit and the new VRF unit pump vapor at approximately the same rate.

TABLE 1

| External Dimensions & Weight | VRF | VR |
|---|---|---|
| Height: | 3.50" | 6.25" |
| Width: | 3.50" | 5.375" |
| Depth: | 6.0" | 6.75" |
| Weight (Pounds): | 10.5 pounds | 30 pounds |

TABLE 2

| Rotation Mass | VRF | VR |
|---|---|---|
| **Motor Impeller & Shaft** | | |
| Weight: | .567" (194% lighter) | 1.101 |
| Diameter: | 1.356" | 2.690 |
| **Pump Impeller** | | |
| Weight: | .468 | 1.639 |
| Diameter: | 2.000 | 3.395 |

TABLE 3

| Motor Chamber Internal Volume | |
|---|---|
| Volume between the vanes | Volume from port to port |
| VR = .289 inch$^3$ = 4.735 ml = .00125 gal | 100 ml = .0264 gal |
| VFR = .150 inch$^3$ = 2.458 ml = .000649 gal | 25 ml = .0066 gal |
| .139 inch$^3$ smaller volume | 75 ml smaller (400% less volume) |

TABLE 4

| Start Up Time | | |
|---|---|---|
| VRF = 225 milliseconds | 8 Gpm | 100 milliseconds faster |
| VR = 335 milliseconds | fast start | 1.49 times quicker starts |
| VRF = 45 milliseconds | 8 Gpm | 105 milliseconds faster |
| VR = 150 milliseconds | slow start | 3.33 times quicker starts |
| | | Avg. 2.41 times quicker (241%) |

In Table 1 it will be seen that the new unit is much less in height and width and about ⅓ the weight of the old unit, which enables the new unit to be housed within many existing fuel dispenser housings, without extensive modifications made to dispenser, rather than having to be added to the outside thereof.

From Table 2 it will be seen that the new unit has only approximately half the motor rotor assembly and shaft diameter as the old unit and has a pump rotor assembly of diameter substantially less than that of the old unit and a pump rotor assembly weight which is between only a third to a quarter that of the old unit. It will thus be understood that the rotational inertia of the rotor assembly in the inventive unit is much less than in the old unit. In Table 3, "volume between the vanes" means the maximum volume circumferentially between adjacent vanes 31 in the crescent space in FIG. 11; and "volume from port to port" means the volume in the motor chamber between the upper threads and lower threads 301 in FIG. 22 with the motor impeller and vanes in place.

As shown in Table 3, the motor chamber volume, from port to port, in the new unit is only about one quarter that of the old unit. A small port to port volume is particularly important for fuel dispensers of the type which enable the consumer to select among different octane fuels to be dispensed from a given hose. Regulatory agencies only allow 0.10 gallon intermixing of fuels as between one fill-up and the next.

Table 4 compares start-up times for the old and new units over a number of start-ups, and with an 8 gallon per minute (Gpm) flow rate from the fuel dispenser P/M. The rotor assembly of the new unit comes up to operating speed approximately 1½ to more than 3 times faster than that of the old unit (in one test about 2.4 times faster on average). This is important because regulatory agencies require and limit the time required to bring the vapor pump up to full speed. Accelerating the rotor assembly from rest to full speed on the average of 2.4 times faster is a substantial improvement, and is even more impressive in that normal operating speed in the new unit is approximately 2½ times faster than in the old unit. More particularly, typical operating speed of the old unit was about a 1,000–1,100 rpm, as compared to about 2,600–2,700 rpm in the new unit.

The Table 4 increase in rotor assembly acceleration results at least in part from the substantial reduction in rotational inertia of the rotor assembly 23 of the new unit compared to that of the old unit, which reduced rotation inertia is a function of reduced rotor assembly mass and effective diameter, lightweight plastic vanes, and reduced internal friction (due for example to careful control of rotor assembly alignment and clearances with respect to the housing and reduced seal friction on the shaft).

Aside from the particular above-discussed new unit listed above at VRF in Tables 1–3 above, size and weight reductions under the present invention are contemplated in the following ranges:

(1) motor impeller and shaft 100% to 275% lighter and pump impeller 200% to 500% lighter;

(2) volume between vanes 100% to 250% smaller and port to port volume 200% to 600% smaller;

(3) start up time 100% to 400% quicker.

Surprisingly, with the motor chamber 20 fed fuel from the usual commercial fuel dispenser P/M, at the usual fuel flow rate, the present invention provides both a reduction in effective motor chamber volume (see for example the above Table 3 port to port volume figures) and a sizeable increase in motor speed. With a port to port volume approximately ¼ of that of the old unit of Table 3, the new unit provides increase of rotor assembly speed of about 2½ times (from about 1,000–1,200 rpm in the old unit to about 2,600–2,700 rpm in the new unit).

In a typical conventional fuel dispenser P/M, the fuel is supplied at approximately 8–10 gallons per minute with the fuel flow controller C fully open. The conventional dispenser P/M can work against a fairly high head of pressure, though with some loss in flow rate with increases in the pressure head that it is pumping against. Conventional dispensers P/M typically operate in a 25–30 pounds per square inch (PSI) range.

The present invention reduces or minimizes this head pressure, to maximize the speed of fuel dispensed into the vehicle fill port FP. The present invention does this by reducing fuel pressure losses across the motor/pump unit 11 at a given fuel flow rate by about 50% as compared to prior VR unit above-discussed, at same fuel flow rate. Indeed, the present invention provides a smaller and faster rotating motor/pump unit with reduced fuel pressure losses and actually improves speed of dispensing (fuel flow rate) at the vehicle fill port FP—a surprising resolution of seemingly conflicting characteristics.

The above-mentioned higher rotational speed, of the motor impeller 25, must result in a corresponding increase in speed of the co-shafted pump impeller 26, which allows a corresponding reduction in the pump impeller and chamber size without degradation of vapor pumping rate. See above Table 2 for an example of reduction in the pump impeller weight and diameter. The reduced sizes of the motor and pump portions of the inventive motor/pump unit 11 allows it to be located in many existing fuel dispensers without external modifications thereof, or allows the inventive unit 11 to be located inconspicuously outside the existing dispenser. Further, the decreased size of both the motor and pump chambers, and hence of the motor/pump unit 11, reduces the overall weight of the unit 11, as above-discussed with respect to Table 1, and the weight reduction is without resort to exotic, expensive, lightweight housing and impeller materials. For example, the housing 16 and rotor assembly 23 (except for the vanes above-described) may respectively be of cast iron and steel. The light weight of the inventive unit 11 makes installation quicker and easier. Further, the smaller size of the motor/pump unit 11, as above-discussed, allows the pump to start and stop quicker due to smaller rotating mass and diameter, enabling the pump to pull a vacuum quicker, for example twice as quick, as the old unit of Tables 1–4 above, enabling inventive unit 11 to more easily meet new stringent efficiency requirements of regulating agencies.

The motor/pump unit 11 embodying the invention, by reason of the adjustability of the needle valve member 190 of the bypass unit 170 (FIGS. 11 and 11A), allows the fuel dealer (for example a gasoline station manager) to adjust the performance of the vapor pumping portion of the unit 11, here by adjusting the amount of fuel F bypassing the motor impeller 25, to maintain stringent efficiency requirements as the composition of gasoline varies for each of the four seasons, as well as to tune the unit 11 to the specific dispenser P/M (FIG. 1) on which it is to be installed.

As generally indicated above, the inventive motor/pump unit 11 dramatically improves a key performance requirement, namely the maximum gallons per minute (Gpm) of fuel that can be outputted by the nozzle N to the vehicle fuel port FP (FIG. 1). More particularly, the inventive unit 11 does of course use the flow of fuel F from the dispenser to do work (to cause the vapor pumping portion thereof to pull a vacuum and thus suck vapor from the vicinity of the fuel port FP back to the dispenser P/M). This use of fuel to do work takes kinetic energy from the flow of fuel and thus tends to slow the flow of fuel reaching the vehicle filling port FP. In the old VR unit there was a substantial loss of fuel flow rate. The inventive new VRF unit cuts this loss of fuel flow rate to about half that in the old VR apparatus. Thus there is approximately a 1 to 1½ Gpm higher fuel flow rate to the vehicle filling port FP with the new VRF unit. In other words, where the old VR system might provide 8 Gpm to the nozzle, the new VRF unit (corresponding to unit 11) would provide at least about 9 Gpm.

Among the keys to this improvement in fuel flow rate are the location and special shape of the inlet and discharge porting of the motor chamber 20, the friction reduction provided by a single shaft lip seal, the particular lip seal configuration, the coating of the adjacent part of the shaft (see for example FIG. 8A at 140), and the shape and material of the motor and pump vanes 31 and 32. The shape of the above-described manifolds, where used, contributes also.

A further advantage of the present invention is the adaptability of the motor/pump unit 11 to interconnect between a wide variety of existing (as well as new) gasoline station dispensers and hoses, which the particular dispenser P/M and hose H here shown are merely convenient examples. As above-indicated in the description of manifolds 230 and 260, existing gasoline stations often wish to use an existing so-called "coaxial" (vapor inside, fuel outside) dispenser P/M with a newer so-called "inverted" (fuel inside, vapor outside) hose to handle fuel and vapor flow between the nozzle N and the vapor pump chamber 21. The present inventive motor/pump unit 11 provides for replaceable connection to the housing 16 of the manifold 260 (FIG. 2), which allows the gasoline station operator to attach his "inverted" hose directly to the unit 11 (through the manifold 260) without special adapters and thence through manifold 230 to a "coaxial" dispenser P/M.

The present invention also allows the housing 16 to carry alternative manifolds, for example at 230 and 290 (FIGS. 10 and 21) on the opposite (upper in the drawings) side of such housing, for direct attachment of the inventive motor/pump unit 11 to existing plumbing in dispensers of different kinds in gasoline stations.

As a further example, the present invention includes providing a fuel outlet manifold (not shown) for the older "coaxial" hose, just in case a station operator wants it. One such "coaxial" manifold would modify the FIG. 10 lower manifold 260 by connecting fuel outlet port 34 axially straight down into recess 272 (like in FIG. 21 manifold 290 and 291) and by connecting vapor inlet port 35 (FIG. 10) to the semi-annular passage (rather like at 292 in FIG. 21) which leads down into the internally threaded (at 263 in FIG. 10) female fuel fitting 262. These direct connect manifolds 230, 260 and 290 greatly improve the speed of gasoline delivery out of the nozzle N by eliminating elbows and fittings required by other vapor recovery devices, and also improve greatly the ease of installation of the motor/pump unit 11 on existing gasoline station dispensers P/M. Further, such manifolds, as at 230, 260, 290, allow the unit 11 to be located in a small space, thus eliminating costly modifications to the existing fuel dispenser P/M in many instances. Further, to adapt a unit 11 to unusual hose H and/or dispenser P/M fittings, the housing 16 can be provided in its form shown in FIG. 22, namely with manifolds removed, for direct connection of the vapor inlet and outlet ports 35 and 36 to already existing plumbing and for use of the fittings 300 (in place of manifolds) to connect to unusual existing fuel dispenser and fuel hose connections.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A motor pump unit, particularly suitable for use in a fuel vapor return system of the kind in which a liquid fuel conducting conduit and fuel vapor conducting conduit define a common fuel vapor return/liquid fuel supply connection to a vapor fuel source and a common fuel vapor return/liquid fuel supply hose connectable to the filling opening of a liquid fuel tank of a vehicle to be fueled, wherein the motor pump unit comprises:

a housing enclosing a motor chamber in said liquid fuel conduit, said motor chamber including a liquid fuel inlet and outlet, said housing also enclosing a pump chamber in said fuel vapor conduit, said pump chamber including a fuel vapor inlet and outlet;

a motor impeller in said motor chamber and rotatable in response to liquid fuel flow through said motor chamber;

a pump impeller in said pump chamber and connected to said motor impeller for rotating thereby and hence for pumping vapor through said fuel vapor conduit;

means for maximizing the rate of liquid fuel flow through said motor pump unit, said means including locating said liquid fuel inlet and outlet in opposite sides of said housing and substantially aligned on an axis transverse to the axis of rotation of said impellers;

a shaft, said motor impeller being connected on said shaft with said pump impeller for rotating same about said axis of rotation in response to liquid fuel flow through said motor chamber, said means for maximizing the rate of liquid fuel flow comprising:

a substantially straight liquid fuel flow path to, through and from said motor pump unit and including:

(1) said alignment of said liquid fuel inlet and outlet substantially on said axis transverse to said axis of rotation of said impellers, (2) said common axis of said liquid fuel inlet and outlet substantially perpendicularly intersecting a central portion of said motor impeller, (3) a common first manifold connectable to said motor pump unit fuel vapor outlet and liquid fuel inlet for connecting same to the fuel vapor return/liquid fuel supply connector of a liquid fuel source, (4) a common second manifold connectable to said motor pump unit fuel vapor inlet and liquid fuel outlet for connecting same through a fuel vapor return/liquid fuel supply hose to a vehicle to be fueled, said first and second manifolds each having a connector remote from said motor pump unit housing, said first manifold having a liquid fuel path and a fuel vapor path leading from said motor pump unit housing to its said remote connector, said second manifold having a liquid fuel path and a fuel vapor path leading from said motor pump unit housing to its said remote connector, (5) said liquid fuel paths in said first and second manifolds being in straight alignment along said motor pump unit liquid fuel inlet and outlet axis at least part way to said connectors, (6) said liquid fuel paths in said manifolds having no more than one bend, (7) said vapor flow path in each of said first and second manifolds bending as required to approach said liquid fuel path in the corresponding manifold without requiring deviation of said liquid fuel path from said straight alignment.

2. The apparatus of claim 1 including vanes on said motor impeller, and in which said motor chamber liquid fuel outlet is defined by a webwork which circumferentially continues the inner peripheral wall of the motor chamber in the form of webs separated by plural holes, the webs being angled across the circumferential path of the vanes and slidably supporting the radially outer edges of said vanes as said vanes sweep circumferentially across said liquid fuel outlet so that no point on the radially outer edge of each vane is unsupported across the full circumferential width of said liquid fuel outlet, said holes between said webs allowing relatively free liquid fuel outlet flow from said motor chamber therethrough.

3. The apparatus of claim 1 in which said liquid fuel outlet is offset circumferentially with respect to the motor impeller rotational axis and toward a side of the motor chamber at which the motor impeller is spaced from the motor chamber inner peripheral wall by a liquid fuel flow space of generally crescent-shaped cross-section, said liquid fuel outlet being of greater effective width at one circumferential end than the other, said wider circumferential end being the end closest to said crescent-shaped cross-section space, for causing liquid fuel to pass from said crescent-shaped cross-section space directly through said liquid fuel outlet and thereby to minimize loss of liquid fuel kinetic energy in passing from said crescent space through said liquid fuel outlet.

4. The apparatus of claim 3 in which said liquid fuel outlet webworks comprises webs arranged in a generally Y-shaped webwork with the leg of a said Y separating symmetrically opposed generally triangular ones of said holes, arms of said Y being disposed between hypotenuse sides of said generally triangular holes and adjacent sides of a generally diamond-shaped one of said holes, wherein said motor impeller vanes are pushed by fuel flow circumferentially along the leg and then along the arms of said Y, said liquid fuel outlet wider end being defined by base portions of said triangular holes, said liquid fuel outlet other end being a narrow end of said diamond-shaped hole.

5. The apparatus of claim 1 including vanes on said motor impeller, and in which said liquid fuel inlet is offset circumferentially with respect to the motor impeller rotational axis and toward said side of the motor chamber at which the motor impeller is spaced from the motor chamber inner peripheral wall by said liquid fuel flow space of generally crescent-shaped cross-section, said liquid fuel inlet being wider at one circumferential end than the other, said wider circumferential end being the end closest to said crescent-shaped cross-section space, for causing said liquid fuel inlet to direct fuel directly against ones of said vanes extending from said motor impeller into said crescent-shaped cross-section space and thereby to maximize application of liquid fuel kinetic energy to rotating said motor impeller.

6. The apparatus of claim 1 in which said first and second manifolds are on opposite sides of said housing, said manifolds having respective liquid fuel inlet and outlet paths connected with said liquid fuel inlet and outlet of said housing and extending in substantially straight alignment with said liquid fuel inlet and said outlet, said first manifold including a vapor outlet path connected to said housing vapor outlet, said second manifold containing a vapor inlet path connected to said vapor inlet of said pump, said vapor paths through said manifolds and housing being sinuous as compared to the substantially straight through liquid fuel paths through said manifolds and housing.

7. The apparatus of claim 6 in which said first and second manifolds connect directly to said housing, said first manifold also connecting direct to a pressurized liquid fuel source and fuel vapor return without intervening fittings, said second manifold connecting directly to a hose leading to a liquid fuel dispensing nozzle insertable in the tank of a liquid fuel consuming device for filling such tank, said second manifold connection being connected directly to such hose without intervening fittings.

8. The apparatus of claim 1 in which said motor impeller carries six circumferentially distributed vanes and said pump impeller carries four thereof.

9. The apparatus of claim 1 including a shaft portion fixedly connecting said motor impeller and pump impeller for rotation of said pump impeller by said motor impeller, said housing having a wall isolating said chambers, said shaft portion extending through said wall, a means limiting shaft friction including only a single lip seal bearing on such shaft portion between said motor chamber and pump chamber and oriented to block liquid flow from said motor chamber to said pump chamber, said shaft portion having a hardened and smoothed radially outer surface rotatably engageable with said lip seal for longer wear and lower running friction with respect thereto.

10. The apparatus of claim 1 in which said motor impeller and pump impeller are relatively fixed parts of a rotor shaft, said housing having end walls and an intermediate wall defining axially therebetween said pump chamber and motor chamber, said intermediate wall and motor chamber end wall having bearings supporting said shaft and thereby located at opposite ends of said motor impeller, said shaft supporting said pump impeller in a substantially cantilevered manner.

11. The apparatus of claim 10 including a generally annular wave spring axially backing one of said bearings to preload same and through the shaft assure a substantially constant axial load on the elements of the bearings during operation.

12. The apparatus of claim 10 including a space receiving for shims at a bearing race at one end of said shaft for proper axial location of said shaft.

13. The apparatus of claim 12 including a clearance space at an opposite end of said shaft from said shim space.

14. The apparatus of claim 10 including an axially spaced pair of annular plates fixed in said housing and in turn axially flanking said motor impeller and vanes, and a resilient ring axially interposed between one of said annular plates and the adjacent housing wall for snugly sandwiching said motor impeller and vanes between said plates in a resilient manner.

15. The apparatus of claim 1 in which said means for maximizing rate of liquid fuel flow further includes means for preventing misalignment and warping of said housing in a manner to limit rotation of said impellers, said housing comprising an axially stacked series of wall members bounding said chambers and secured together by elongate screws, and elongate tapered pins driven into elongate tapered holes drilled after said screws are tightened, to positively prevent relative lateral motion of said wall members.

16. The apparatus of claim 1 including vanes radially slidable in both slots in said impellers and in which said liquid fuel flow rate maximizing means include means for limiting frictional drag of said vanes as they slide on the interior periphery of said chambers, and including (1) constructing vanes of a relatively lightweight material, namely of a plastics material, to reduce centrifugal forcing together of said vanes and chamber peripheral walls during rotation, and (2) skeletonizing said vanes to further lighten the same, and (3) narrowing the thickness of said vanes at the radially outer edge thereof to substantially less than the circumferential thickness of the corresponding vane slots in the motor and pump impellers for reduced contact area between vanes and the motor pump unit housing.

17. The apparatus of claim 16 including radially extending flow channels in said vanes in the side of said vanes facing toward the flow, for assisting radially inward travel of the fluid in said chamber into the slots, to press on the radially inner edges of said blades and press same gently out radially toward the peripheral wall of the corresponding chamber during rotation, and to allow free radially inward and outward motion of the vanes with respect to the impeller slots, without developing a vacuum in said slot or trapping fluid in said slots behind said vanes during rotation.

18. The apparatus of claim 1 in which a given said impeller has vanes which are of molded plastic material and have the form of relatively thin plates with reinforcing protrusions on one side thereof to rigidify same and tend to prevent warping during molding and curing.

19. The apparatus of claim 1 in which said housing comprises an axial stack of radial and tubular wall members and resilient rings interposed between adjacent wall members for sealing and centering ones of said wall members defining at least one of said motor chamber and pump chamber to maintain centering of rotating components with respect to said housing.

20. The apparatus of claim 1 including a needle valve adapted to bypass fluid around said pump chamber to change the amount of vapor pumping work performable by said pump impeller.

21. The apparatus of claim 1 in which said housing comprises a cup at one end thereof and having a recess facing toward a remainder of the housing in a direction generally axially of said impellers, and an insert axially slidably received in said recess, said insert having a substantially axially aligned through hole, said through hole having an inner peripheral wall defining the inner peripheral wall of one of said chambers, means fixing said insert against rotation within recess, means for fixing the recessed end of said cup to said housing remainder, said last mentioned chamber being disposed axially between an end wall of said cup and said housing remainder.

22. The apparatus of claim 21 in which said recess is of generally circular cylinder shape, said insert having an external corresponding generally circular cylinder shape, said hole and said insert being located eccentrically therein and defining the peripheral wall profile of said chamber, said cup having an open end face at the open end of said recess for abutting a corresponding end face on said housing remainder, removable fastening means for fastening said cup and housing remainder with said faces opposed in sealed fashion, said insert rotation preventing means comprising an element extending substantially axially between said insert and said cup end wall for positively blocking rotation of said insert in said recess, said end wall containing said fuel vapor inlet and outlet, which fuel vapor inlet and outlet open axially into said hole in said insert, said hole in said insert being of greater diameter than axial depth, said pump impeller being received in and rotatable in cooperable with said hole in said insert for pumping vapor from said vapor inlet to said vapor outlet.

23. The apparatus of claim 1, including a shaft fixedly connecting said motor and pump impellers, and means for minimizing rotating friction of said shaft, motor impeller and pump impeller to maximize transfer of kinetic energy from liquid fuel flowing through said liquid fuel chamber to pumping of said fuel vapor by said pump impeller; in which said means for minimizing rotating friction comprises a single lip seal bearing on said shaft between said motor chamber and pump chamber, vanes of lightweight material, namely of a rigid plastics material, for reducing centrifugal forcing together of (1) said vanes and (2) motor and pump chamber peripheral walls during rotation of said impellers, and skeletonized vane structure with radially outer vane edges substantially less thick than the circumferential thickness of slots in said impellers in which said vanes are received, for reduced contact between said vanes and said motor pump unit housing.

24. The apparatus of claim 1 in which said first manifold connector has a central liquid fuel inlet, said housing fuel vapor outlet extending axially from said pump chamber and having a first bend into substantial parallelism with said liquid fuel inlet, said first manifold fuel vapor path having a second bend to guide fuel vapor from said housing fuel vapor outlet toward said manifold liquid fuel path, said first manifold fuel vapor path having a third bend into parallelism with the liquid fuel path of said first manifold as said fuel vapor and liquid fuel paths approach said connector of said first manifold, said fuel vapor path at least partially annularly surrounding said liquid fuel path at said first manifold connector.

25. The apparatus of claim 1 wherein said second manifold liquid fuel path extends substantially straight from said motor pump unit housing to said second manifold connector and more particularly to an at least semi-annular portion thereof, said housing fuel vapor inlet extending axially from said pump chamber and having a first bend into substantial parallelism with said liquid fuel outlet, said second manifold fuel vapor path bending through a second bend adjacent said housing fuel vapor inlet to extend toward said second manifold liquid fuel path, said second manifold having a third bend adjacent said liquid fuel path and connector of said second manifold, said second manifold fuel vapor path near said second manifold connector being at least partially annularly surrounded by said second manifold liquid fuel path.

26. The apparatus of claim 1, including means for positively adjusting the rate of vapor pumping comprising a bypass passage around one of said chambers and valve means adjustable for varying bypassing through said bypass path of one of said liquid fuel and fuel vapor.

27. The apparatus of claim 26 in which said bypass passage and valve means are connected to said fuel inlet and outlet of said motor chamber.

28. The apparatus of claim 26 in which said bypass valve means comprises an internally threaded fitting, a first recess in said housing for fixedly receiving said fitting, a reduced diameter second recess in said housing extending said first recess thereinto and having an annular inboard end, a third recess continuing said second recess into said housing and ending in a valve seat in said bypass passage, a needle valve member having an outboard portion threadedly received in the internally threaded portion of said fitting and for threaded axial adjustment therein, said needle valve member having an inboard end portion engageable with said valve seat for closing said bypass passage and removable from said valve seat for opening said bypass passage, a resilient seal ring snugly axially disposed between the inboard end of said fitting and the inboard end of said second recess, said seal ring snugly radially receiving said needle valve member therethrough and being snugly radially received in said second recess for sealingly engaging (1) the inboard end of said fitting, (2) the inboard end of said second recess, (3) said needle valve member and (4) an inner peripheral wall of said second recess upon tightening of said fitting into said housing.

29. The apparatus of claim 28 including a washer axially interposed between the inboard end of said fitting and said seal ring for axially backing said seal ring, said fitting having an inboard facing internal recess for receiving an annular rib on said needle valve member and of diameter greater than the minimum diameter of the threaded portion within said fitting, said threaded portion within said fitting lying axially outboard of said recess therein, said washer radially inwardly overlapping said recess in said fitting.

30. The apparatus of claim 1 including means associated with at least one of said chambers for positively adjusting of the rate of fuel vapor pumping through said fuel vapor conduit by said pump impeller by a liquid fuel station operator to compensate for seasonal variations in fuel vapor production.

31. The apparatus of claim 30 including means for minimizing rotating friction of said shaft, motor impeller and pump impeller to maximize transfer of kinetic energy from liquid fuel flowing through said motor fuel chamber to pumping of said fuel vapor by said pump impeller.

* * * * *

UNITED STATES PATENT AND TRADEMARK OFFICE

CERTIFICATE OF CORRECTION

PATENT NO. : 5,575,629

DATED : November 19, 1996

INVENTOR(S) : Scott Marlin Olson, et al

It is certified that error appears in the above-indentified patent and that said Letters Patent is hereby corrected as shown below:

Column 23, line 57; change "said" to ---a---.

Column 28, line 16; delete "fuel" (second occurrence).

Signed and Sealed this

Second Day of February, 1999

*Attest:*

*Attesting Officer*

*Acting Commissioner of Patents and Trademarks*